US005257466A

United States Patent [19]

Kishi

[11] Patent Number: 5,257,466

[45] Date of Patent: Nov. 2, 1993

[54] RAW SEWAGE DISPOSAL APPARATUS

[75] Inventor: Mitsuhiro Kishi, Tochigi, Japan

[73] Assignee: Japanic Corporation, Tochigi, Japan

[21] Appl. No.: 784,595

[22] Filed: Oct. 29, 1991

[30] Foreign Application Priority Data

Dec. 19, 1990 [JP] Japan ..... 2-411577
Mar. 8, 1991 [JP] Japan ..... 3-067538
Jul. 3, 1991 [JP] Japan ..... 3-189280

[51] Int. Cl.[5] ..... F26B 13/26

[52] U.S. Cl. ..... 34/95; 34/179; 4/111.1

[58] Field of Search ..... 34/95, 179, 181, 60, 34/71; 4/111.1, 111.5, 111.6, 449

[56] References Cited

U.S. PATENT DOCUMENTS 4,999,930 3/1991 Kishi et al. ..... 34/95
5,058,213 10/1991 Kishi et al. ..... 4/111.1

*Primary Examiner*—Henry A. Bennet
*Assistant Examiner*—Denise L. Gromada
*Attorney, Agent, or Firm*—Flynn, Thiel, Boutell & Tanis

[57] ABSTRACT

A raw sewage disposal apparatus, such as a portable toilet. The apparatus has a vessel with a first introduction pipe for feeding raw sewage into the vessel. The vessel is externally heated and contains heat-holding bodies and an agitator so that the sewage can be heated to evaporate liquid therefrom while being agitated to break down nonevaporable substances into powder. Air is circulated through the vessel to remove the vapor and later the powder therefrom. A deodorizing means including a catalyst, and a preheater for preheating the catalyst, are provided to treat the vapor to make it substantially odorless. A dust collector is provided to collect the powder. The dust collector can be heated, if necessary, to evaporate liquid present therein. A liquid level detector can be provided on the vessel to indicate when the vessel contains a large amount of raw sewage.

25 Claims, 33 Drawing Sheets

RAW SEWAGE DISPOSAL APPARATUS

BACKGROUND OF THE INVENTION

1. Field of the Invention

The present invention relates to a sewage disposal apparatus for disposing of raw sewage, which apparatus can be utilized in the outdoors, in a transportation vehicle such as a vessel or train, or in a tunnel through which a tank truck used for collecting raw sewage (hereinafter referred to as a vacuum truck) cannot go and, more particularly, relates to such an apparatus which is provided with a dust collector capable of removing the dust that remains in the apparatus after drying the raw sewage and a heating means for heating catalyst means capable of undergoing long use and facilitating maintenance and inspection thereof.

2. Description of the Prior Art

The raw sewage discharged from human bodies is typically discharged into a sewage system by use of a flush toilet or the like and then is flowed into a river after being temporarily stored in a holding tank and purified therein. However, at events such as festivals, athletic events, fairs, meetings and the like, temporary toilet facilities must be provided to dispose of raw human waste.

Employed conventionally are movable temporary toilets, most of which have a tank for temporarily storing the raw sewage therein. However, the temporary toilets have the problem that the raw sewage stored in the tank must be sucked into a vacuum truck for collection, which is laborious and time consuming, for maintenance thereof after use of them, and is unhygienic.

Transportation vehicles, such as buses, trains, vessels, etc., which operate over long distance are provided with a tank exclusively used for storing and holding the discharged raw sewage. The raw sewage in this tank is subjected to a deodorizing treatment by chemicals and thereafter is collected by the vacuum truck.

As mentioned above, the raw sewage in conventional temporary toilets or movable transportation facilities is stored as it is discharged from the human body and is collected thereafter. Accordingly, the storing method, the collection method and the disposal method all are not modern and very unhygienic.

In an attempt to ameliorate the above problems, there have been proposed several hygienic disposal methods. In one method, for example, chemicals are introduced into the tank where the raw sewage is stored to thereby prevent the bad smell and to effect sterilization of the sewage. This is mainly employed in the transportation industry, such as on trains like the Shinkansen Express in Japan. This method, however, cannot be used for a long period of time because the chemicals become diluted and costs are high.

In another method, the raw sewage is stored in a bag made of vinyl and the like to prevent the diffusion of the bad smell. This method, however, requires a vinyl bag of large size and involves a high cost for disposal thereof, and it is troublesome to separate the raw sewage from the bag.

In still another method, the discharged raw sewage is directly dried by use of heat from a burner, etc. Since the primary component of raw sewage is liquid, a large amount of heat energy is required to remove the liquid and it takes a long time to effect disposal of the raw sewage.

In view of the drawbacks of the conventional methods of disposing of the raw sewage, the present inventor proposed a disposing apparatus having a casing provided with stirring blades and heat holding bodies therein in which the raw sewage is stirred by the rotation of the stirring blades and heated by heat generated by the heat holding bodies whereby the raw sewage is dried in a short period of time as disclosed in Japanese Patent Laid-Open Publication Nos. 63-124150, 63-172852, 63-190857, 63-292789 and Application No. 63-198858, corresponding to U.S. Ser. No. 315,028, now U.S. Pat. No. 4,999,930, and its divisional application Ser. No. 609,378, filed Nov. 5, 1990. According to the proposed disposal methods, the raw sewage is heated, vaporized in a casing and the liquid component of the raw sewage is vaporized and diffused into the ambient atmosphere. Before the liquid component is diffused, the components which cause a bad smell are resolved by a catalyst so that the vapor is diffused into the atmosphere as an odorless vapor. It was preferable to employ such a method in view of environmental hygiene and preservation even if such method is employed in crowded buildings and/or by throngs of people.

Another related U.S. application is Ser. No. 575,910, filed Aug. 29, 1990.

SUMMARY OF THE INVENTION

It is therefore a first object of the present invention to provide a raw sewage disposal apparatus capable of meeting the demand for improvements in the conventional raw sewage disposal apparatus.

To achieve the first object of the present invention, the raw sewage disposal apparatus, according to the first aspect of the present invention, comprises a heat-resistant vessel for containing raw sewage therein, an introduction pipe connected to the vessel for introducing the raw sewage, a heating means for heating and drying the raw sewage, a stirring means having a plurality of stirring blades for stirring the raw sewage in the vessel, a plurality of heat-holding bodies contained in the vessel, a nozzle through which air is jetted into the vessel, a dust collection means for collecting the dust from the air that is discharged from the vessel, a deodorizing means communicating with the dust collection means and having therein a catalyst for removing the bad odors, and a secondary heating means and an air introduction pipe connected to the deodorizing means.

It is a second object of the present invention to provide a raw sewage disposal cauldron capable of lowering the position of the stool so that user can use the stool conveniently since it is not necessary to sit on a high stool.

To achieve the second object of the present invention, the raw sewage disposal apparatus, according to the second aspect of the present invention, comprises a heat-resistant vessel for containing raw sewage therein, an introduction pipe connected at one end to a stool and at the other end to the vessel for introducing the raw sewage, closure valve means provided at the introduction pipe, a heating means for heating and drying the raw sewage, a stirring means having a plurality of stirring blades for stirring the raw sewage in the vessel, a plurality of heat-holding bodies contained in the vessel, a nozzle through which air is jetted into the vessel, a dust collection means for collecting the dust from the air that is discharged from the vessel, a deodorizing means having therein a catalyst for removing the bad odors, a secondary heating means connected to the deodorizing means and the dust collection means, an air introduction pipe connected to the secondary heating means and an air drawing means connected to the deodorizing means for drawing the air in the deodorizing means.

It is a third object of the present invention to provide a raw sewage disposal apparatus provided with a liquid level detecting means capable of preventing the amount of raw sewage that enters the vessel from exceeding a predetermined amount so that the raw sewage can be dried and evaporated in the vessel at the proper cycle without applying a severe load on the apparatus.

To achieve the third object of the present invention, the raw sewage disposal apparatus, according to the third aspect of the present invention, comprises a heat-resistant vessel for containing raw sewage therein, an introduction pipe connected at one end to a stool and at the other end to the vessel for introducing the raw sewage, liquid level detecting means for detecting the level of raw sewage in said vessel, closure valve means provided at the introduction pipe, a heating means for heating and drying the raw sewage, a stirring means having a plurality of stirring blades for stirring the raw sewage in the vessel, a plurality of heat-holding bodies contained in the vessel, a nozzle through which air is jetted into the vessel, a dust collection means for collecting the dust from the air that is discharged from the vessel, a deodorizing means having therein a catalyst for removing the bad odors, a secondary heating means connected to the deodorizing means and the dust collection means, an air introduction pipe connected to the secondary heating means and an air drawing means connected to the deodorizing means for drawing the air in the deodorizing means.

It is a fourth object of the present invention to provide a raw sewage disposal apparatus provided with a secondary heater for heating a catalyst capable of preventing the vapor generated in a vessel from contacting the vessel so that the vapor and the catalyst can be indirectly heated.

To achieve the fourth object of the present invention, the raw sewage disposal apparatus, according to the fourth aspect of the present invention, comprises a heat-resistant vessel for containing raw sewage therein, an introduction pipe connected at one end to a stool and at the other end to the vessel for introducing the raw sewage, closure valve means provided at the introduction pipe, a heating means for heating and drying the raw sewage, a stirring means having a plurality of stirring blades for stirring the raw sewage in the vessel, a plurality of heat-holding bodies contained in the vessel, a nozzle through which air is jetted into the vessel, a dust collection means for collecting the dust from the air discharged from the vessel, a deodorizing means communicating with the dust collection means and having therein a catalyst for removing the bad odors, a secondary heating means connected at one end thereof to an air introduction pipe and at the other end thereof to the deodorizing means and an air drawing means connected to the deodorizing means for drawing the air in the deodorizing means.

DESCRIPTION OF PREFERRED EMBODIMENTS

First Embodiment (FIGS. 1 to 6)

Figure 1:
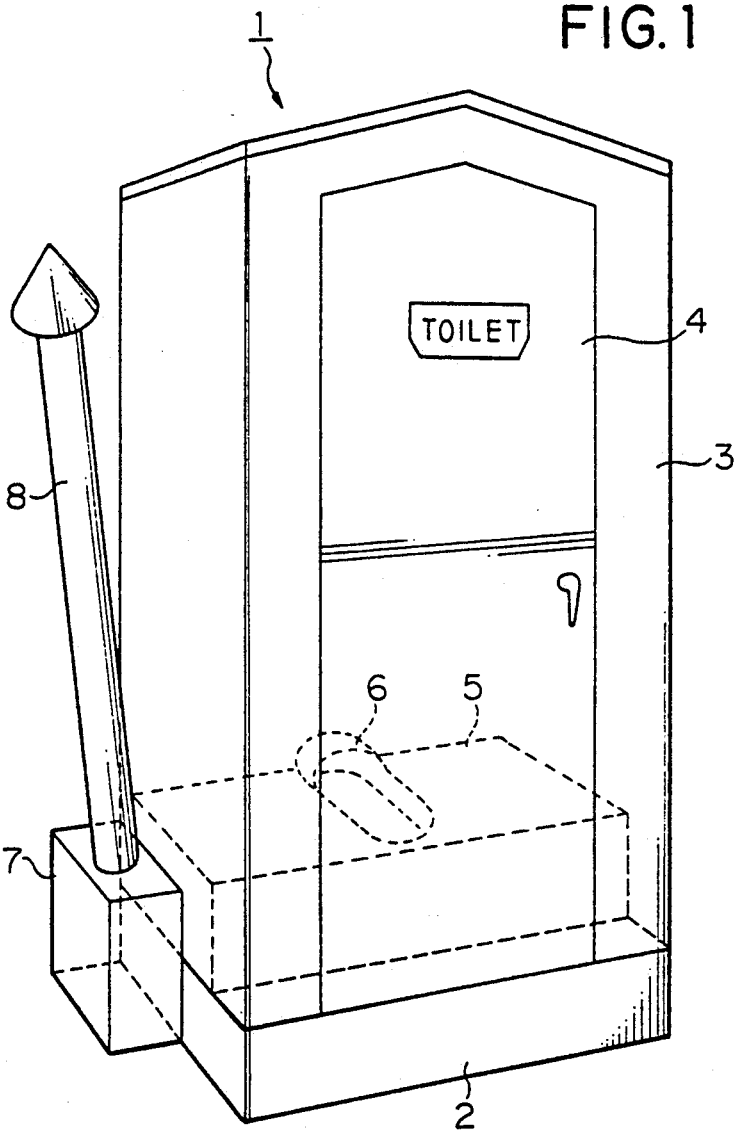
FIG. 1 is a perspective view of a raw sewage disposal apparatus employed in a temporary toilet according to a first embodiment of the present invention.

A raw sewage disposal apparatus, according to a first embodiment of the present invention, will be described with reference to FIGS. 1 to 6. Described in the first embodiment is a temporary toilet 1, incorporating a raw sewage disposal apparatus, movable by a truck or the like. In FIG. 1, the temporary toilet 1 is made of plastic or reinforced synthetic resin and has a box-like shape. The toilet 1 has a base 2 which can be supported on the ground and which has a roofed house 3 fixed thereto. A door 4 is attached to a front portion of the house 3. The temporary toilet 1 has inside thereof a raw sewage disposal apparatus 5 which is fixed to an upper portion of the base 2. A stool 6 is fixed to an upper portion of the disposal apparatus 5 for receiving the raw sewage. The base 2 has a dust collection unit 7, serving also as a deodorizing unit, disposed at the side thereof which is provided with a diffusion pipe 8 at the upper portion thereof for diffusing the evaporated liquid, (i.e., vapor) component of the raw sewage to the atmosphere.

The raw sewage disposal apparatus 5 comprises an outer casing 11 made of thin steel plate of a cubic shape and which is open at the upper portion thereof, an outer cover 12 fixed to a top peripheral surface of the outer casing 11, a supporting plate 13 formed of a heat-resistant material, such as a thin stainless steel, and protruding laterally inwardly from the inner periphery of the outer casing 11, an evaporation cauldron or kettle 14 having a semispherical curved lower portion and an open upper portion, an inner cover 15 fixed to a top peripheral surface of the evaporation cauldron 14, and a heat insulating material 16 made of glass, wood, etc., interposed in the space 17 between the outer casing 11 and the evaporation cauldron 14.

Figure 3:
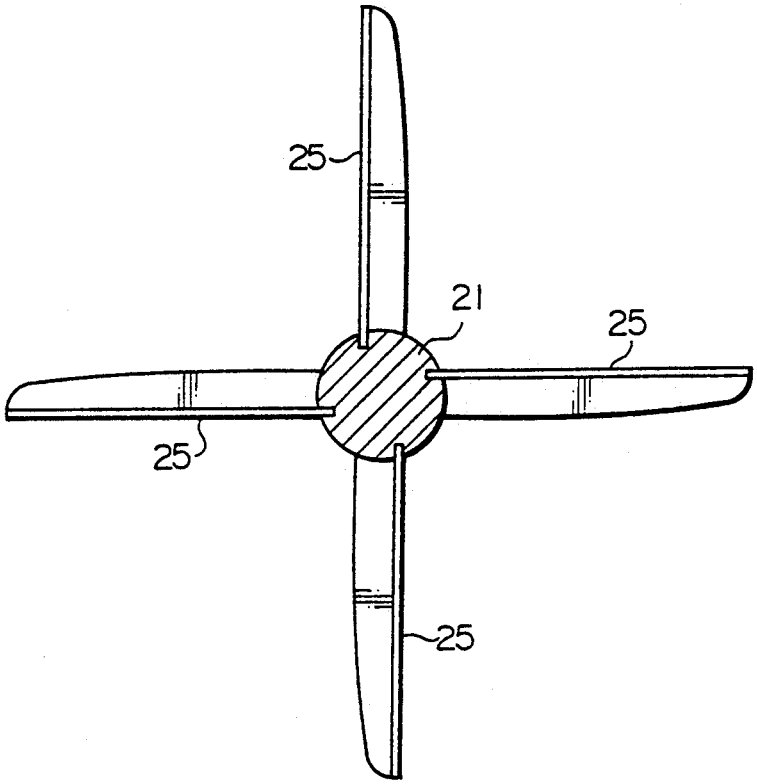
FIG. 3 is a plan view showing the stirring blades of the raw sewage disposal apparatus of FIG. 1.

The raw sewage disposal apparatus 5 also comprises a heater 18 at the outer bottom and outer peripheral surface of the evaporation cauldron 14 for heating the evaporation cauldron 14 when the heater is energized. The raw sewage apparatus 5 further comprises bearings 19, 20 respectively fixed to the central portions of the outer cover 12 and the inner cover 15, the drive shaft 21 rotatably mounted coaxially on the bearings 19, 20 and penetrating vertically inside the outer casing 11 and the evaporation cauldron 14 substantially along the central vertical axis thereof and having a concave recess 22 in the lower end thereof for receiving therein a projection 23 protruding upwardly from the bottom of the evaporation cauldron 14 for rotatably supporting the lower end of the drive shaft 21. Four radially projecting stirring blades 25 are fixed to the lower portion of the drive shaft 21 at 90° angular intervals as shown in FIG. 3 and positioned close to the curved bottom of the evaporation cauldron 14. A worm gear 26 is fixed to the upper portion of the drive shaft 21. A worm 27 is engaged with the worm gear 26. A sprocket wheel 28 is fixed to the worm 27. A sprocket wheel 30 is fixed to a motor 31 mounted on the outer cover 12. A chain 29 is trained around the sprocket wheels 28 and 30 for transmitting the output of the motor 31 to the worm 27. A plurality of heat holding balls 24, made of ceramic, such as alumina, or metal are contained in the evaporation cauldron 14. An introduction pipe 33 vertically penetrates the covers 12 and 15 for communicating between the stool 6 and the evaporation cauldron 14 so that the raw sewage is introduced from the stool 6 to the evaporation cauldron 14. A shutter or valve 34 is provided within the introduction pipe 33 for preventing the bad odors from exhausting and for preventing the hot air from flowing back from the cauldron 14 toward the stool 6. The shutter 34 can be moved horizontally by a motor, described later.

Figure 4:
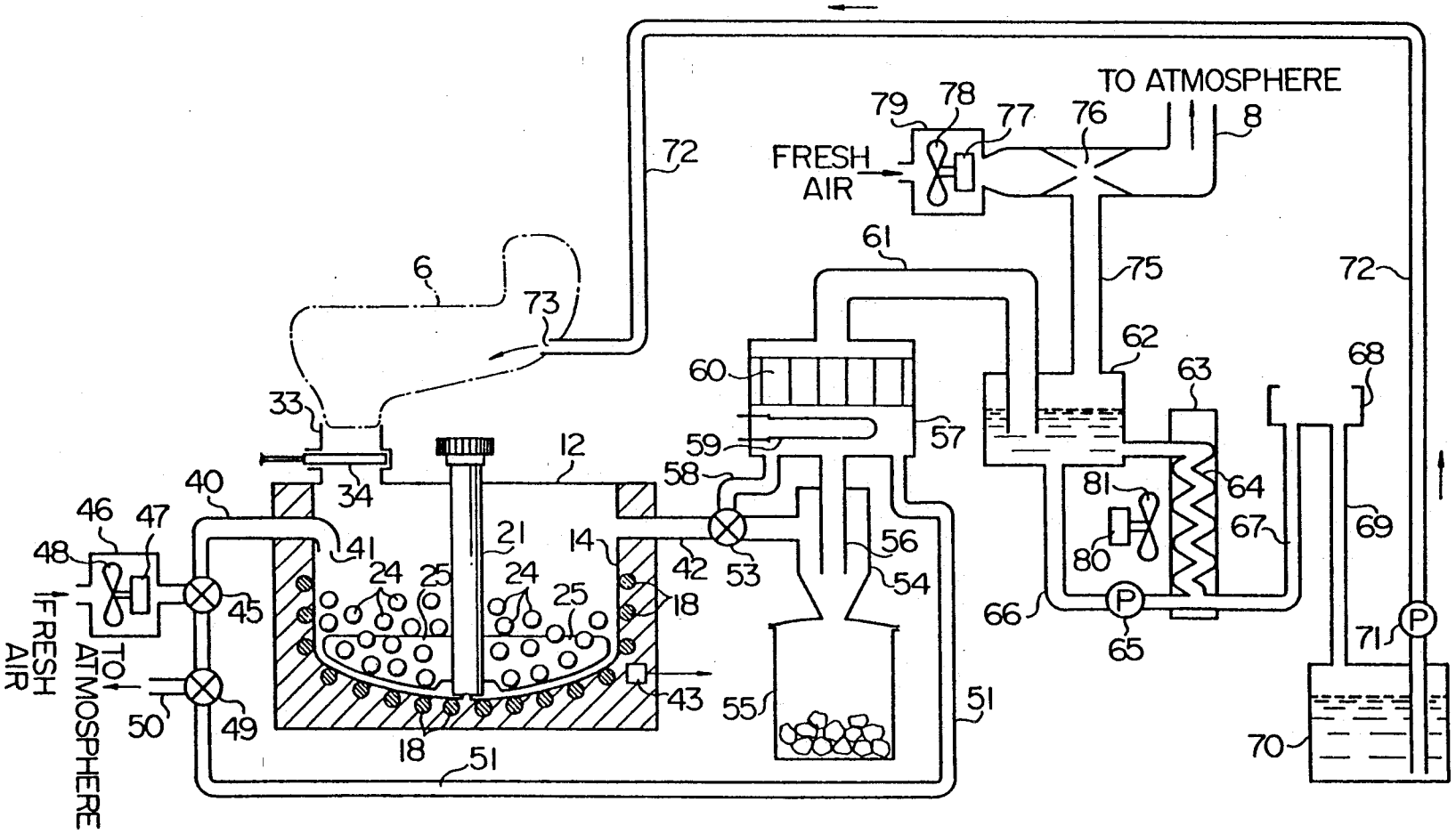
FIG. 4 is a view showing a piping system for connecting the components of the raw sewage disposal apparatus of FIG. 1.

An air introduction pipe 40 is connected to an inner side portion of the evaporation cauldron 14 and has a nozzle 41 which is directed downwardly and tapered at the tip end thereof. A duct 42 is connected to the inner side portion of the evaporation cauldron 14 disposed opposite to the air introduction pipe 40 for discharging air in the evaporation cauldron 14. The duct 42 communicates with the exterior of the outer casing 11. A temperature sensor 43 is disposed between the outer casing 11 and the evaporation cauldron 14 at a location close to the bottom of the outer casing 11 for detecting the temperature rise in the evaporation cauldron 14. FIG. 4 shows a piping system between the raw sewage disposal apparatus 5, the dust collection unit 7 and the related equipment.

The air introduction pipe 40 is connected to a blower 46 by way of a first selector valve 45 which can be switched to three positions in the piping circuit. The air blower 46 has therein a motor 47 and a fan 48 driven by the motor 47 so that fresh air from the ambient atmosphere is supplied toward the first selector valve 45. A pressure regulating valve 49 is connected at a first side thereof to one output side of the first selector valve 45 for regulating the air pressure and at a second side to a diffusion pipe 50 and at a third side to a preheat pipe 51. A second selector valve 53 is connected to the duct 42 in which the second selector valve 53 is also switched to three positions in the piping circuit. A cyclone-type dust collector (hereinafter referred to simply dust collector) 54 is connected to a first side of the second selector valve 53 for forcing dust-laden air to flow into a spiral path and separate the dust from the air. A dust collection box 55 is connected to a lower portion of the dust collector 54 for collecting the separated dust. A duct 56, serving as a clean air outlet, is disposed at the center of the dust collector 54 for merely flowing the air from which the dust has been separated. The pipe 56 communicates with an airtight catalyst box 57.

A bypass pipe 58 is connected between the lower portion of the catalyst box 57 and the second port of the selector valve 63. The preheat pipe 51 is also connected to the lower portion of the catalyst box 57. The catalyst box 57 is hollow inside thereof and has a secondary heater 59 fixed at TM the lower portion thereof and a honeycomb catalyst 60, such as platinum and the like, fixed at the upper portion thereof.

A cooling pipe 61 is connected to the upper portion of the catalyst box 57. The cooling pipe 61 is bent downward in U-shape and has a tip end extending to the inner portion of a condensate return tank 62. The condensate return tank 62 is always filled with water. The cooling pipe 61 has a lower end which opens under the liquid surface in the condensate return tank 62. A radiator pipe 64 of a radiator 63 is connected at one end thereof to a side surface of the condensate return tank 62 and at the other end thereof to one end of a circulating pipe 66 having a pump 65 therein. The circulating pipe 66 is connected at the other end thereof to the bottom of the condensate return tank 62.

A regulating water pipe 67 is connected to a lower portion of the radiator pipe 64 and has an upper end extending directly upwardly to a regulating box 68. The lower end of the regulating box 68 is connected to the upper end of the regulating water pipe 67 and to the upper end of the collection pipe 69. A water tank 70 for storing the condensate return water is connected to the lower end of the collection pipe 69. A flushing pipe 72 is connected at one end thereof to the water tank 72 by way of a pump 71 and at the other end thereof is connected to the inner portion of the stool 6 for defining a nozzle 73. A diffusion pipe 75 is connected at the lower end thereof to the upper space of the condensate return tank 62 and at the upper end thereof to an ejector 76. The ejector 76 has one opening connected to an air blower 79 housing a motor 77 and a fan 78 therein and the other opening is connected to the diffusion pipe 8.

A fan 81 is driven by a motor 80 and is effective to cool the liquid that is circulated through the radiator 63.

Figure 5:
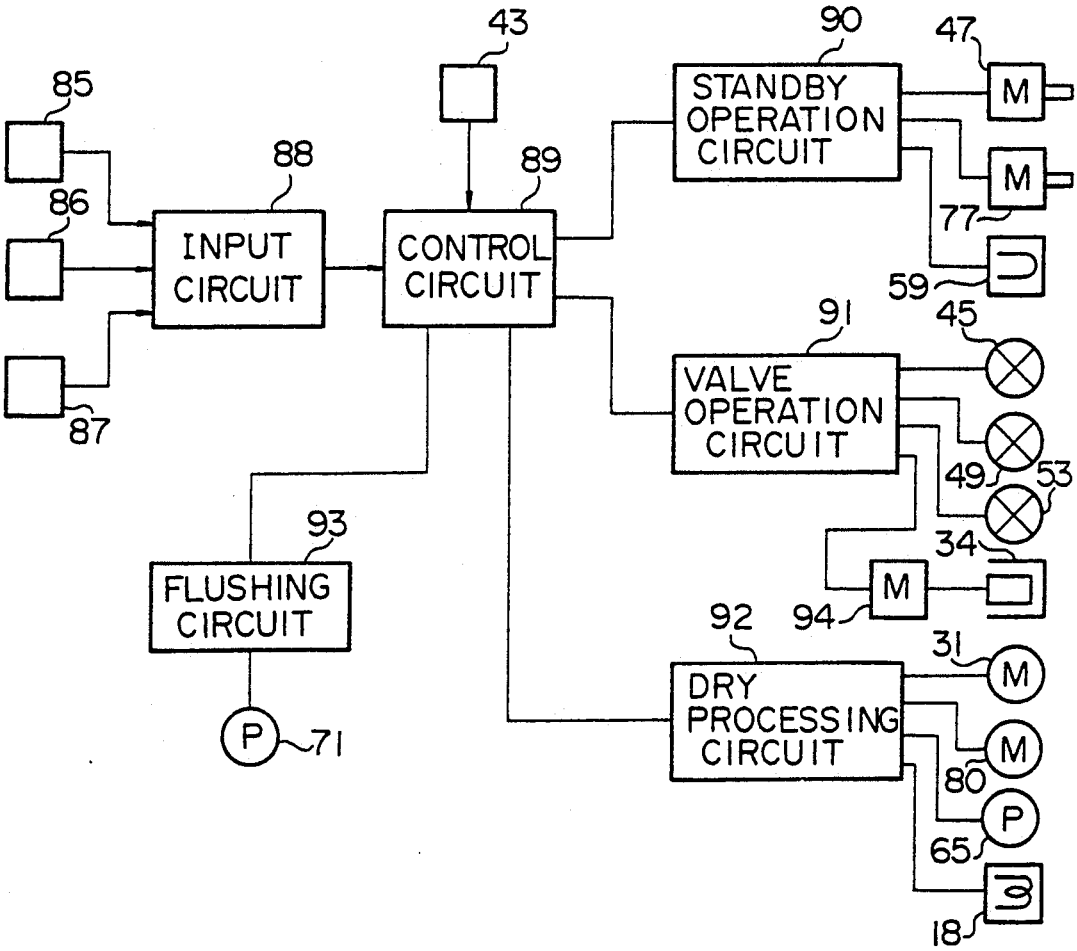
FIG. 5 is a block diagram showing a control system of raw sewage disposal apparatus of FIG. 1.
Figure 6:
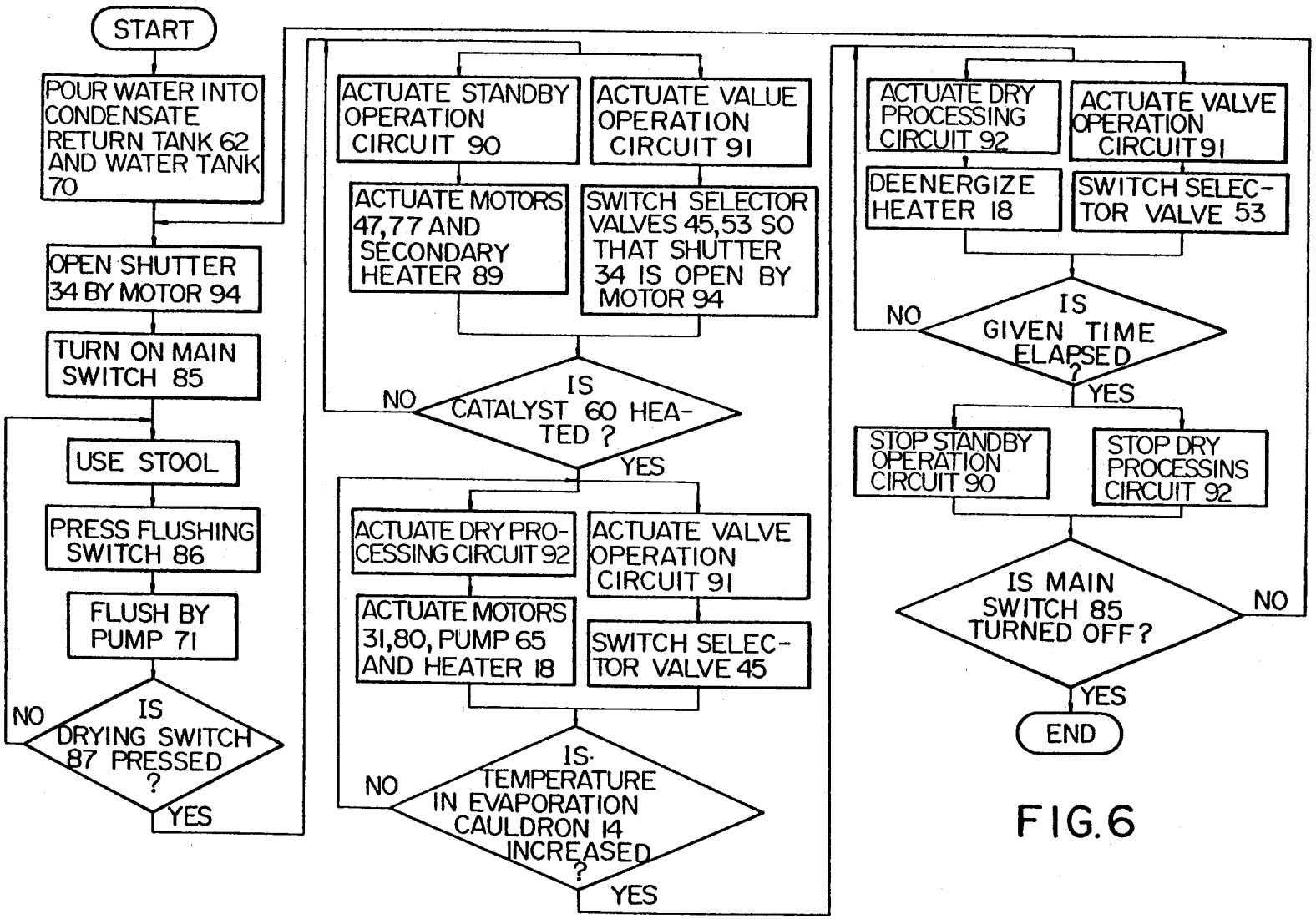
FIG. 6 is a flow chart showing an operation of the raw sewage disposal apparatus of FIG. 1.
Figure 7:
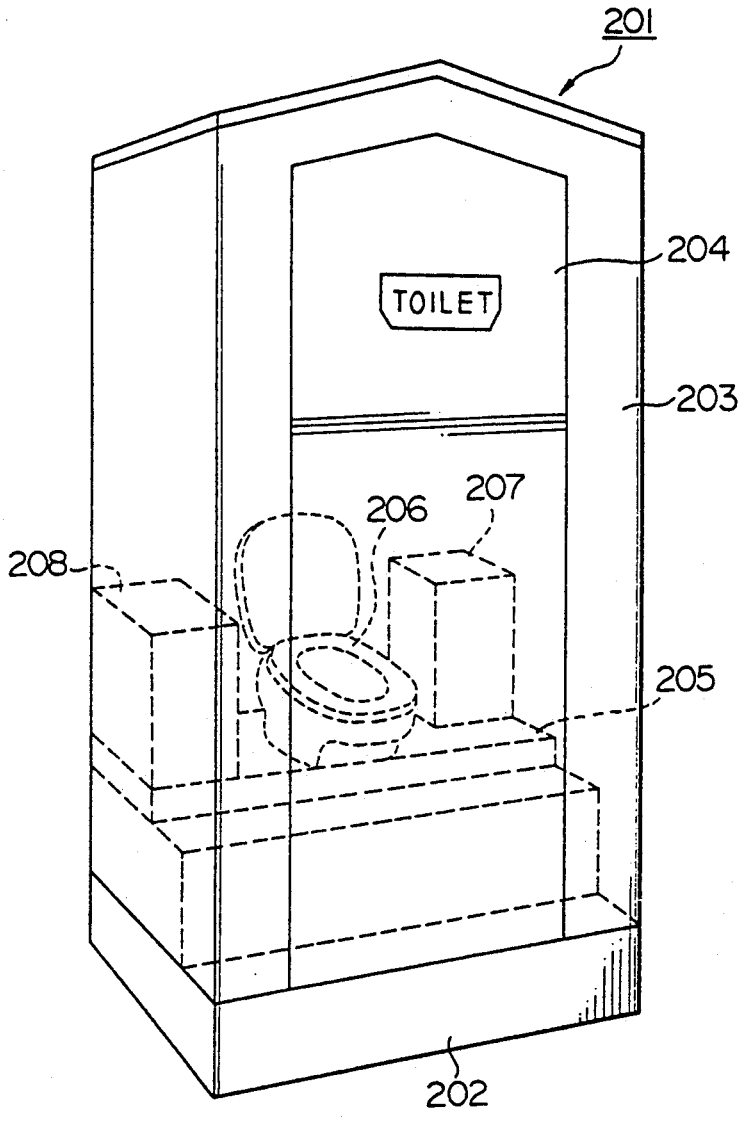
FIG. 7 is a perspective view of a temporary toilet having a raw sewage disposal apparatus therein according to a second embodiment of the present invention.
Figure 8:
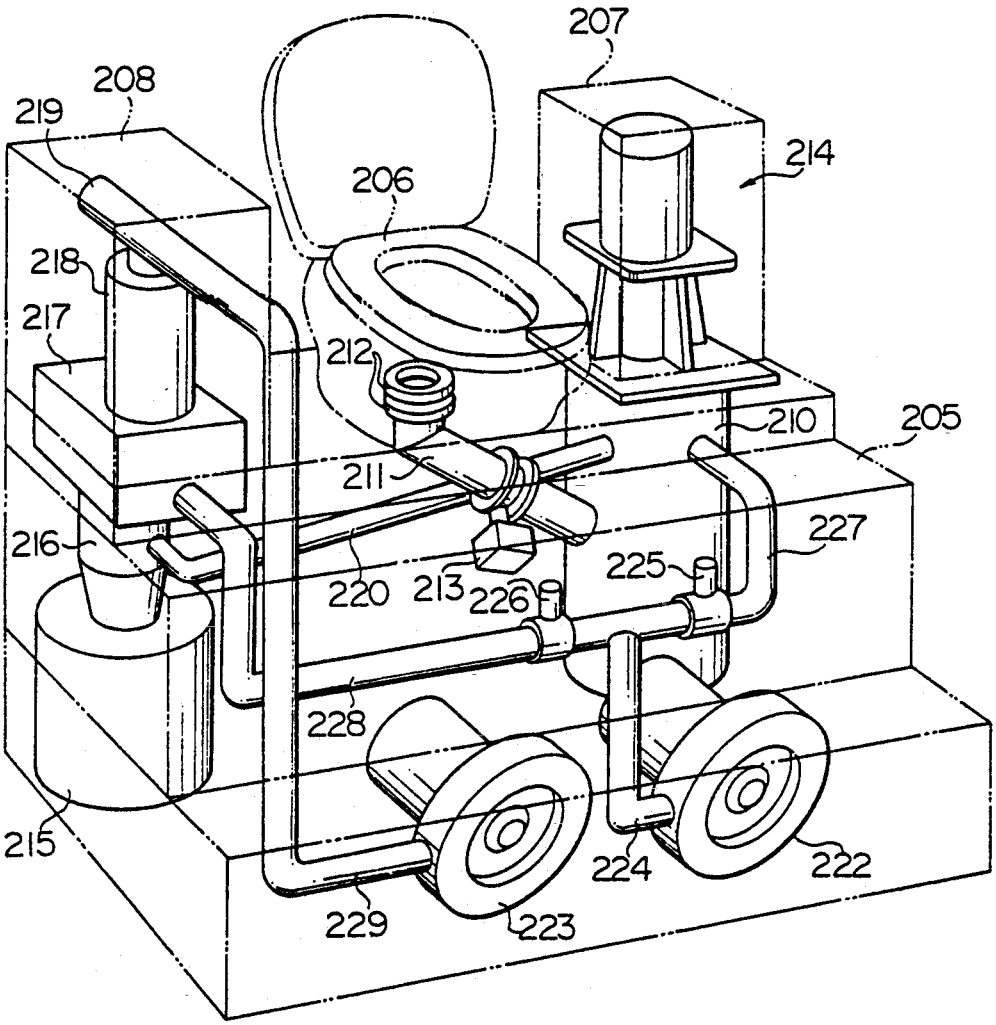
FIG. 8 is a schematic view showing the internal structure of the raw sewage disposal apparatus of FIG. 7.

FIG. 5 is a block diagram showing a control circuit according to a first embodiment of the present invention.

Connected to an input circuit 88 are a main switch 85 for controlling an entire arrangement of the raw sewage disposal apparatus 5, a flushing switch 86 for flushing the temporary toilet 1 and a drying switch 87 for initiating a drying operation. The input circuit 88 is connected at an output side thereof to a control circuit 89 which receives a temperature signal from the temperature sensor 43. Connected to the control circuit 89 are a standby operation circuit 90, a valve operation circuit 91, a dry processing circuit 92 and a flushing circuit 93.

Connected to the standby operation circuit 90 are the motors 47, 77 and the heater 59. The valve operation circuit 91 is connected for operating the first selector valve 45, the pressure regulating valve 49 and the second selector valve 53. The valve operation circuit 91 is connected to a motor 94 for operating the shutter 34. The dry processing circuit 92 is connected to operate the motors 31, 80, the pump 65 and the heater 18. Connected to the flushing circuit 93 is the pump 71.

The operation of the raw sewage disposal apparatus according to the first embodiment of the present invention will be described hereinafter.

Before using the temporary toilet 1, a predetermined amount of water is poured into both the return tank 62 and the water tank 70 while the motor 94 is operated to open the shutter 34. When the shutter 34 is opened, the stool 6 communicates with the evaporation cauldron 14.

The main switch 85 is turned on to actuate the control circuit 89 for rendering the raw sewage disposal apparatus 5 in a standby state.

In use, the user opens the door 4 and enters the temporary toilet 1 and excretes raw sewage which is discharged into the stool 6. The discharged raw sewage is introduced into the evaporation cauldron 14 from the stool 6 by way of the introduction pipe 33 and is stored in the evaporation cauldron 14. The raw sewage is typically classified into feces, urine, paper and the like, all of which are stored in the evaporation cauldron 14 until a certain amount of them is filled in the cauldron.

When the stool 6 is to be cleaned by the user, the flushing switch 86 should be pressed. The signal issued by the flushing switch 86 is supplied to the flushing circuit 93 by way of the input circuit 88 and the control circuit 89. The flushing circuit 93, upon reception of the signal from the control circuit 89, drives the pump 71. When the pump 71 is driven, the flushing water stored in the water tank 70 is drawn and discharged from the nozzle 73 by way of the flushing pipe 72. The flushing water jetted by the nozzle 73 cleanses the inner periphery of the stool 6 and thereafter is introduced into and stored in the evaporation cauldron 14 by means of the introduction pipe 33.

The raw sewage is stored in the evaporation cauldron 14 after the use of the apparatus 1 by the user. Since the evaporation cauldron 14 has a limited capacity for storing the raw sewage, it is impossible to store an amount of the raw sewage which is larger than a predetermined capacity. Accordingly, the drying operation is carried out in the evaporation cauldron 14 when a predetermined amount of raw sewage is stored therein.

The drying operation is started when the drying switch 87 is pressed. A signal generated by the pressing of the drying switch 87 is supplied to the control circuit 89 by way of the input circuit 88.

When the drying switch 87 is pressed, the standby operation circuit 90 is actuated to thereby operate the motors 47 and 77 and energize the secondary heater 59. The valve operation circuit 91 is simultaneously operated to thereby switch the first selector valve 45 to connect it via pressure regulating valve 49 to the preheat pipe 51, while the second selector valve 53 is operated to connect the duct 42 and the bypass pipe 58. At the same time, the motor 94 is driven to close the shutter 34, thereby rendering the evaporation cauldron 14 airtight. When the motor 47 is driven, the fan 48 is also driven so that the fresh air is supplied to the first selector valve 45. The fresh air is then supplied toward the regulating valve 49 by switching of the first selector valve 45, and part of the fresh air is supplied to the diffusion pipe 50 by the regulating valve 49 and thereafter is diffused into the atmosphere. The part of the fresh air that does not flow from the diffusion pipe 50 is reduced in the pressure thereof and flows into the catalyst box 57 by way of the preheat pipe 51. Since the heater 59 housed in the catalyst box 57 is heated when it is energized, the air supplied through the preheat pipe 51 is directed through the catalyst box 57 so that the heat from the secondary heater 59 flows toward the catalyst 60, thereby heating the catalyst 60. When the catalyst 60 is at a lower temperature, the vapor including the bad smell component is not effectively oxidized as it passes over the catalyst 60. Accordingly, the reason that the catalyst 60 is preheated is to prevent the bad smell from diffusing outside.

When the motor 77 is operated, the fan 78 is driven so that the air from the fan 78 is supplied to the diffusion pipe 8 by way of the ejector 76. The ejector 76 is negatively pressurized at the center thereof so that the air in the upper space of the condensate return tank 62 is drawn through the discharge pipe 75 into the ejector and thence flows to the diffusion pipe 8.

With this series of operations, the drying preparation operation of the raw sewage disposing apparatus 5 is completed by heating the catalyst 60 by the heat from the secondary heater 59.

When a prescribed time for the drying preparation operation has elapsed, a signal is issued from the control circuit 89 to the drying processing circuit 92 whereby the drying operation is started.

At first, the first selector valve 45 is switched to supply the fresh air to both the air introduction pipe 40 and the pressure regulating valve 49. Since the first selector valve 45 supplies the air to both the air introduction pipe 40 and the pressure regulating valve 49, the amount of fresh air jetted from the nozzle 41 is slightly reduced and is supplied into the evaporation cauldron 14. The air jetted from the nozzle 41 passes through the evaporation cauldron 14, then passes through the duct 42, the second selector valve 53 and the bypass pipe 58 and thereafter flows into the catalyst box 57.

When the motor 80 is operated, the fan 81 is driven to thereby cool the water circulating through the radiator pipe 64 so that the radiator pipe 64 is always kept cold. The pump 65 allows the water to circulate in the radiator pipe 64, the circulating pipe 66 and the condensate return tank 62 so that the water cooled by the radiator pipe 64 is always returned to the condensate return tank 62.

When the heater 18 is energized, the heater 18 radiates heat which heats the bottom of the evaporation cauldron 14, thereby heating the raw sewage stored in the evaporation cauldron 14. The motor 31 is operated simultaneously with the heating of the evaporation cauldron 14. Since the rotary output of the motor 31 drives the sprocket wheel 30, the same rotary output is transmitted to the drive shaft 21 by way of the chain 29, the sprocket wheel 28, the worm 27 and the worm gear 26. By the rotation of the drive shaft 21, the stirring blades 25 are rotated and the heat holding bodies 24 are also moved about in the evaporation cauldron 14 so that the temperature of the raw sewage in the evaporation cauldron 14 rises uniformly. As a result, the heat held by the heat holding bodies 24 heats the raw sewage contacting the surfaces thereof which expedites drying of the raw sewage. When the stirring blades 25 are rotated, the heat holding bodies 24 are moved about together with the raw sewage so that the raw sewage is crushed into small pieces and the solidified materials of the raw sewage are reduced into powder as the drying operation of the raw sewage progresses and comes to an end.

As the drying operation progresses, the liquid component which is the main portion of the raw sewage in the evaporation cauldron 14 is evaporated to form vapor which fills the evaporation cauldron 14. Since the fresh air is always supplied into the evaporation cauldron 14 from the nozzle 41, the vapor is forced to move toward the catalyst box 57 by way of the second selector valve 53 and the bypass pipe 58.

Since the secondary heater 59 in the catalyst box 57 is already heated, the thus-moved vapor, including the bad smell components, is heated by the secondary heater 59 to a high temperature and is flowed to contact the catalyst 60. The bad smell components, such as ammonia and urea, are oxidized by the catalyst 60 and changed into odorless vapor and are discharged into the cooling pipe 61. Since the lower end of the cooling pipe 61 is positioned under the liquid level of the water stored in the condensate return tank 62, the air including the vapor is cooled when it contacts the water. The vapor is cooled by the cold water in the condensate return tank 62 and is condensed as distilled water. Successively, the cooled noncondensible gas component is drawn into the ejector 76 due to the negative pressure generated in the ejector 76 and diffused into the atmosphere from the diffusion pipe 8 by way of the discharge pipe 75.

The vapor generated in the evaporation cauldron 14 is successively discharged from the cooling pipe 61 and collected in the condensate return tank 62 where the vapor is condensed and changed into condensate water. When the amount of water is increased, a part of the water is discharged from the upper portion of the condensate return pipe 67 into the water regulating tank 68 and then is introduced into the water tank 70 from the collection pipe 69. The water stored in the water tank 70 serves as the flushing water.

As mentioned above, the liquid component of the raw sewage in the evaporation cauldron 14 is evaporated by the operations of each mechanism. Remained lastly in the evaporation cauldron 14 is the solid material, such as cellulosic material, paper and the like, in the form of powder. When these residual substances have accumulated in the evaporation cauldron 14, the drying operation is not effectively carried out in the evaporation cauldron 14. Therefore, the inside of the evaporation cauldron 14 should be cleaned in preparation for the next disposal of the raw sewage. The cleaning operation should be automatically carried out every time the drying operation is completed.

That is, when the liquid component has been evaporated, the temperature in the evaporation cauldron 14 rises and the change of the temperature is detected by the temperature sensor 43 which issues a temperature signal. The control circuit 89, upon reception of the temperature signal, completes the drying operation and judges that the solid material, the cellulosic material and the dust, are stored in the evaporation cauldron 14. The control circuit 89 supplies a signal to the valve operation circuit 91 and deenergizes the heater 18 and switches the second selector valve 53 to thereby connect the duct 42 to the dust collector 54. The control circuit 89 then switches the first selector valve 45 to thereby directly connect the air blower 46 to the air introduction pipe 40 so that the entire amount of the fresh air from the air blower 46 is supplied into the air introduction pipe 40. The thus supplied fresh air is jetted by the nozzle 41 into the evaporation cauldron 14 to thereby blow off the powdered ash or the dust that remains in the evaporation cauldron 14 which are flowed into the duct 42.

Inasmuch as the air in the discharge pipe 75, the cooling pipe 61 and the catalyst box 57 is drawn by the negative pressure in the ejector 76, the air from the duct 42 including the dust is forced to flow toward the dust collector 54, together with the air jetted by the nozzle 41. The dust collector 54 has the cyclone double cylindrical structure in which the air is forced to move in a vortical manner in the space of the double cylindrical structure so that the dust having a higher specific gravity drops in the collector box 55 while the air alone flows toward the catalyst box 57 by way of the air introduction pipe 56. The air flows into the diffusion pipe 8 by way of the cooling pipe 61, the condensate return tank 62 and the discharge pipe 75.

After the strong flow of fresh air is jetted by the nozzle 41 for a prescribed period for cleaning the evaporation cauldron 14, the cleaning operation is automatically terminated by a timer and the like.

The temporary toilet 1 should be in standby condition for the next user after the successive drying and cleaning operations are carried out.

When the control circuit 89 judges that the cleaning operation is terminated by a timer or the like, it stops the standby operation circuit 90 to thereby stop the operations of both the motors 47 and 77 and the secondary heater 59. At the same time, the control circuit 89 stops the drying operation circuit 92 to thereby stop the operations of both the motors 31 and 80, the pump 65 and the heater 18. The control circuit 89 switches both the first and second selector valves 45 and 53 and the pressure regulating valve 49 to thereby return the temporary toilet 1 to the original state. The control circuit 89 then operates the motor 94 so that the shutter 34 is moved and the introduction pipe 33 is opened to communicate with the stool 6 and the evaporation cauldron 14 whereby the temporary toilet 1 is placed in the standby state.

With the arrangement of the raw sewage disposal apparatus according to the first embodiment, it is possible to evaporate the liquid component of the raw sewage stored in the evaporation cauldron and dispose of the raw sewage in a hygienic manner without generating bad smells, in contrast to the prior art procedure in which the discharged sewage was conventionally collected by a vacuum truck and disposed outside the raw sewage disposing apparatus.

Automatically cleaned by the air flow are the residual substances, such as the dust, the nonflammable ash and the like which reside in the evaporation cauldron after the drying operation. Accordingly, maintenance for cleaning the evaporation cauldron is not necessary so that the temporary toilet can be used for a long period of time at the place where the temporary toilet is first installed.

Since the catalyst is always heated in the standby state and during the drying operation, the odoriferous substances are effectively oxidized and bad smells are not discharged outside.

Second Embodiment (FIGS. 7 to 13)

A raw sewage disposing apparatus, according to a second embodiment, will be described with reference to FIGS. 7 to 13.

The raw sewage disposal apparatus 205 comprises a cylindrical evaporation cauldron 210 fixed to the right inner portion thereof and an introduction pipe 211 connected to the central side portion of the evaporation cauldron 210, which pipe is inclined with respect to the vertical toward the upper portion thereof. The upper end of the introduction pipe 211 extends to a lower portion of a stool 206. A shutter 212 is interposed between the upper portion of the introduction pipe 211 and the stool 206. A valve mechanism 213, such as a butterfly valve and the like, is disposed in the inclined intermediate portion of the introduction pipe 211. A drive mechanism 214 is fixed to the upper portion of the evaporation cauldron 210 for stirring the raw sewage stored therein. The drive mechanism 214 is covered by a cover 207. A dust collection box 215 is provided at the left inner lower portion of the raw sewage disposing apparatus 205 for collecting the separated dust. A cyclone dust collector 216 is connected to the upper portion of the dust collection box 215 and is connected to a secondary heater box 217. A cylindrical catalyst box 218 is connected at the lower portion thereof to the upper portion of the secondary box 217 and also connected at the upper portion thereof to an ejector 219 which is disposed in parallel with the secondary heater 217 for drawing the fresh air therein. A discharge pipe 220 is connected between the upper side portion of the evaporation cauldron 210 and the dust collector 216.

Two air blowers 222 and 223 are disposed at the right and left front lower portions of the raw sewage disposal apparatus 205. A discharge pipe 224 is connected at one end to the air blower 222 and is branched at the other end thereof. One branch of the discharge pipe 224 is connected to one end of an air introduction pipe 227 by way of a closing valve 225 and the other branch is connected to one end of an air introduction pipe 228 by way of a closing valve 226.

The air introduction pipe 228 is connected to the side surface of the secondary heater box 217. A discharge pipe 229 connected to the air blower 223 communicates with one end of the ejector 219.

Figure 9:
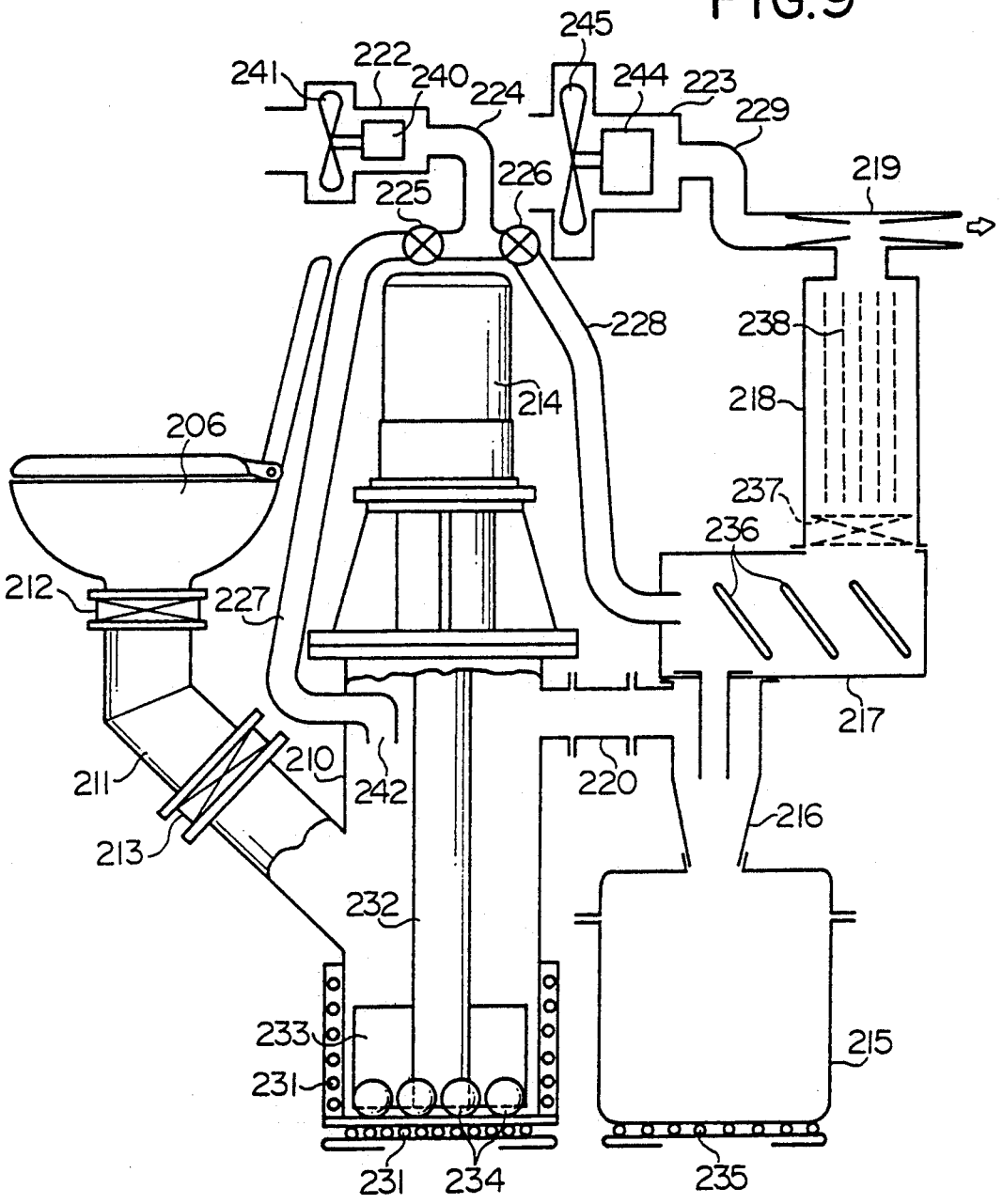
FIG. 9 is a schematic view showing a piping system for connecting the components of the raw sewage disposal apparatus of FIG. 7.

FIG. 9 shows the piping system between the evaporation cauldron 210, the dust box 215 and the stool 206.

The stool 206 is connected to the shutter 212 which is connected to an open end of the introduction pipe 211. The introduction pipe 211 is inclined aslant relative to the evaporation cauldron 210 and is connected to the central side surface of the evaporation cauldron 210. A valve mechanism 213 is interposed midway along the introduction pipe 211. The evaporation cauldron 210 for heating the discharged raw sewage and evaporating the water thereof is cylindrical and hollow and has a bottom wall at the lower end thereof. A heater 231 is wound around the bottom of the evaporation cauldron 210 and the lower side periphery thereof. A drive mechanism 214, such as a motor or the like, is mounted on the upper portion of the evaporation cauldron 210. The upper open end of the evaporation cauldron 210 is closed by the drive mechanism 214. A rotary shaft 232 extends from the bottom surface of the drive mechanism 214 toward the bottom portion of the evaporation cauldron 210 and has a lower end provided with stirring blades 233 protruding therefrom. Stored inside the evaporation cauldron 210 is a plurality of spherical heat-holding bodies 234 to be moved about by rotation of the stirring blades 233. The heat-holding bodies 234 are formed of a high heat-holding material, such as $Al_2O_3$.

A vent is open at the upper side surface of the evaporation cauldron 210 and a discharge pipe 220 for flowing the vapor is connected to the vent. The discharge pipe 220 is connected at the other end thereof to the dust collector 216. The dust collector 216 is of the cyclone type and is constructed in such a manner that the inner diameter thereof progressively diminishes in a downward direction. The dust collector 216 is connected to the upper portion of the dust collection box 215 which is hollow inside thereof and is comprised of a separable cover and a barrel. A heater 235 contacts the bottom surface of the dust collection box 215 for evaporating again the condensed water included in the collected dust which is separated from the air.

A secondary heat box 217 is connected to the upper portion of the dust collector 216. The inside of the secondary heat box 217 communicates with the inside of the dust collector 216 for receiving gas therefrom. As a result, the air from which only the dust has been removed is introduced into the secondary heat box 217. A plurality of secondary heaters 236 are arranged inside the secondary heat box 217 and are substantially inclined so as to contact the air flow. A catalyst box 218 is mounted on the secondary heat box 217 and communicates therewith. The catalyst box 218 has a filter 237 at the inner lower portion thereof and the upper portion thereof is filled with a catalyst 238 composed of platinum and the like. The ejector 219 for drawing the air by negative pressure is connected to the upper portion of the catalyst box 218 for discharging the air inside the catalyst box 218.

A fan 241 driven by a motor 240 is housed in the air blower 222. The fresh air supplied under high pressure by the air blower 222 is branched into air introduction pipes 227 and 228 which are closable by first and second closing valves 225 and 226.

One end of the air introduction pipe 227 is connected to the first closing valve 225 and its other end is connected to the upper portion of the evaporation cauldron 210. A nozzle 242 of the air introduction pipe 227 is open and is directed toward the lower portion of the evaporation cauldron 210. The air introduction pipe 228 connected to the second closing valve 226 communicates with the sidewall of the secondary heat box 217. The air blower 223 has inside thereof a motor 244 and a fan 245 driven by the motor 244. The air supplied under high pressure by the air blower 223 is supplied to the ejector 219 by way of the air introduction pipe 229.

Figure 10:
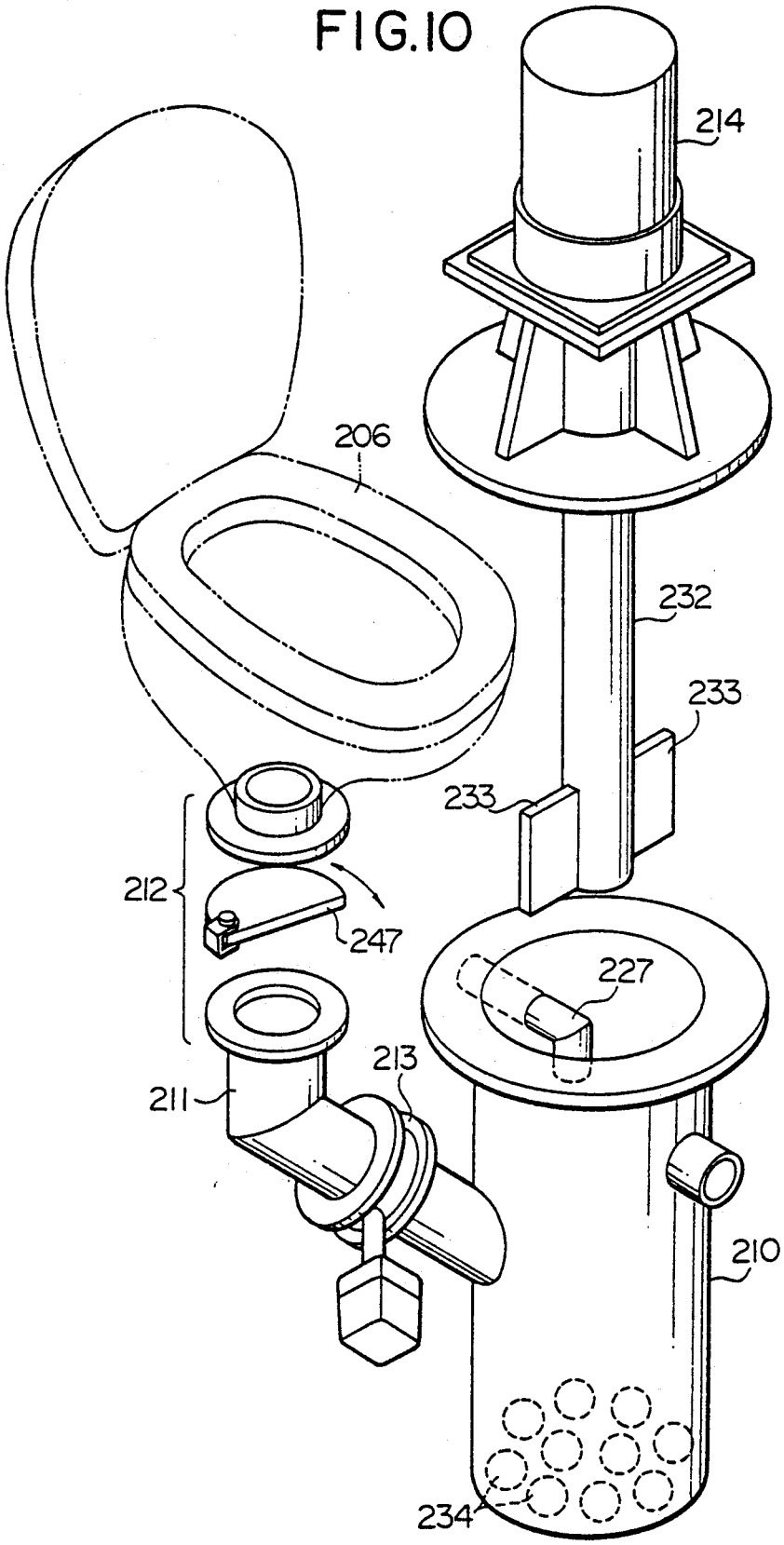
FIG. 10 is an exploded perspective view showing an evaporation cauldron and a stool, which are components of the raw sewage disposal apparatus of FIG. 7.
Figure 11:
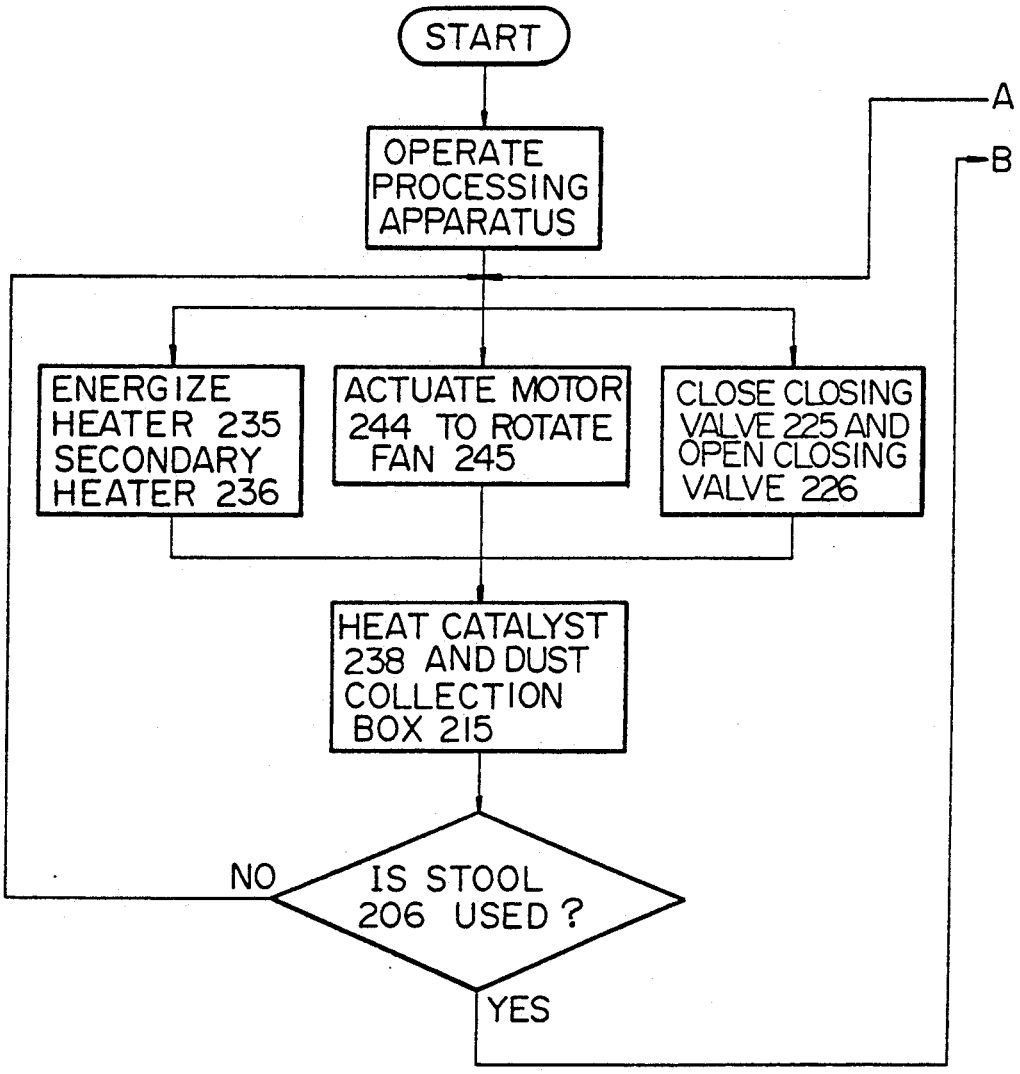
FIGS. 11 to 13 are views showing an operation of the raw sewage disposal apparatus of FIG. 7.
Figure 12:
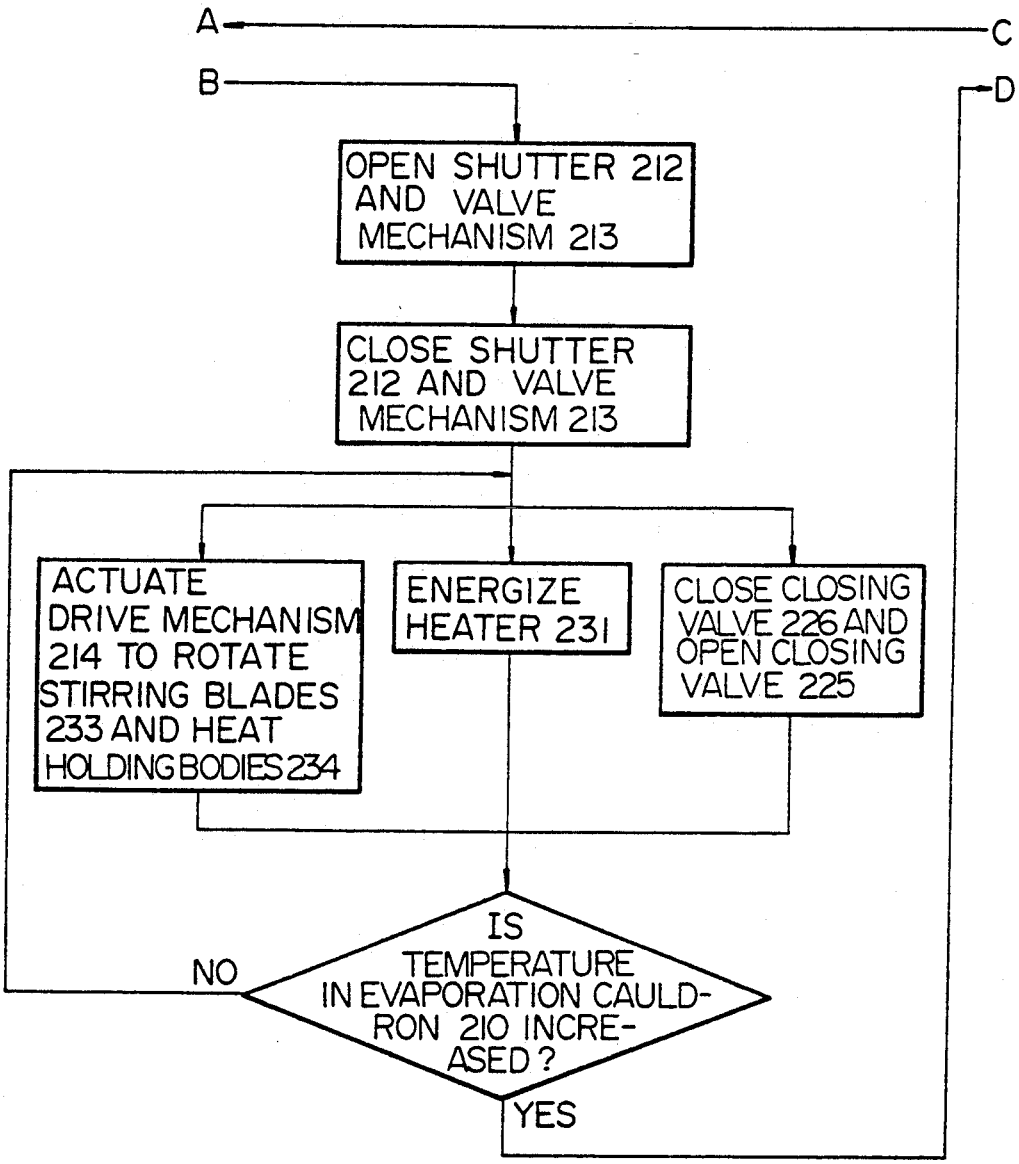
Figure 13:
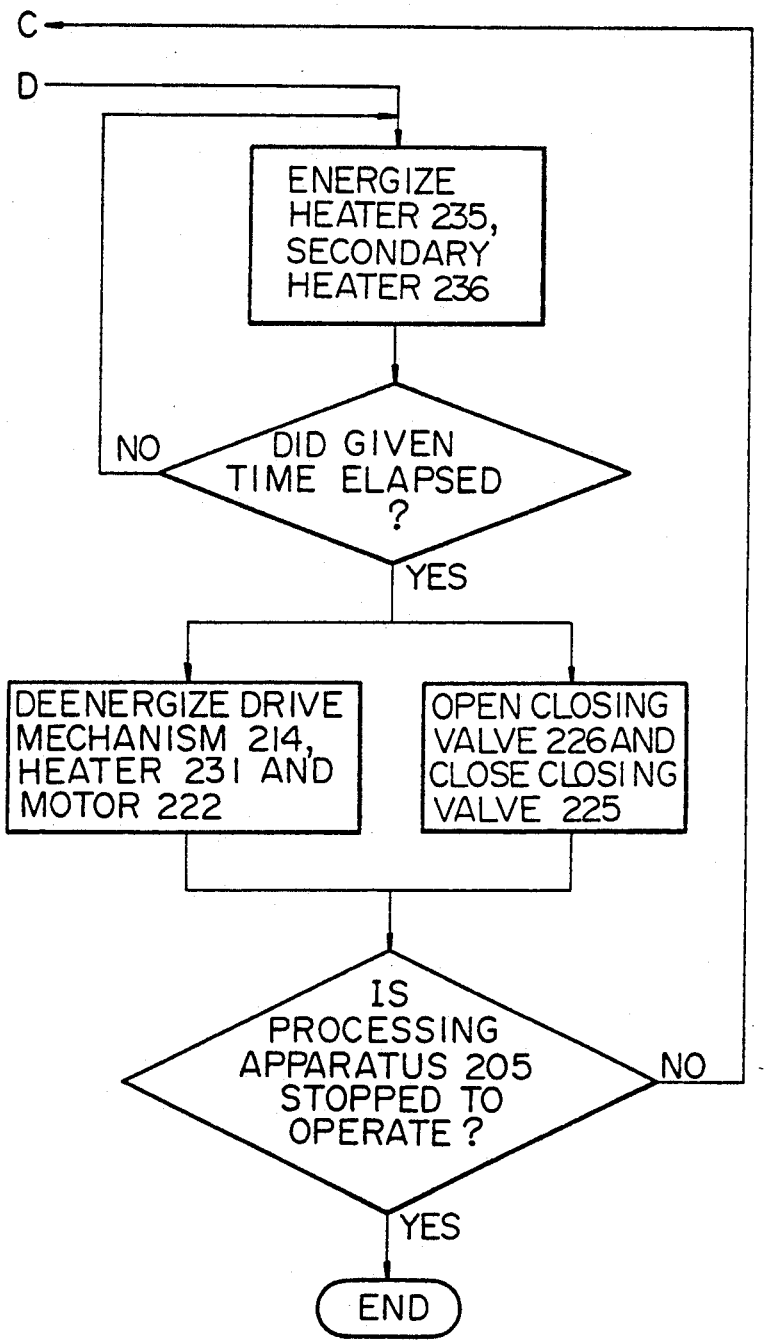
Figure 14:
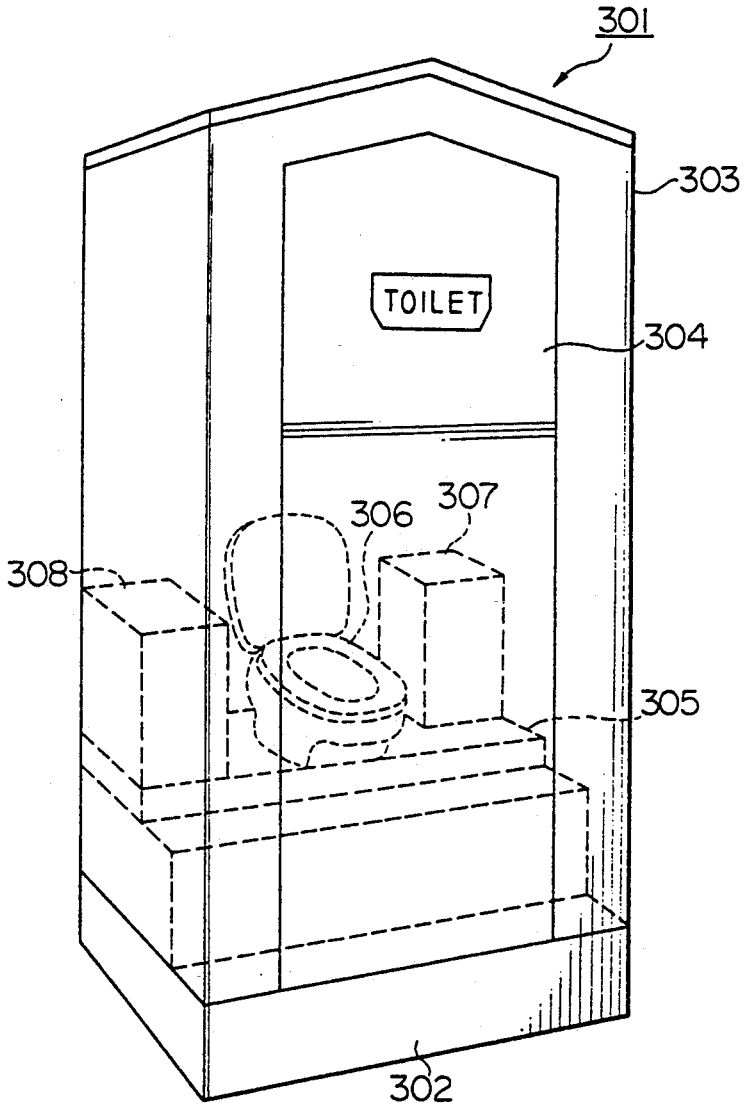
FIG. 14 is a perspective view of a temporary toilet having a raw sewage disposal apparatus therein, according to a third embodiment of the present invention.
Figure 15:
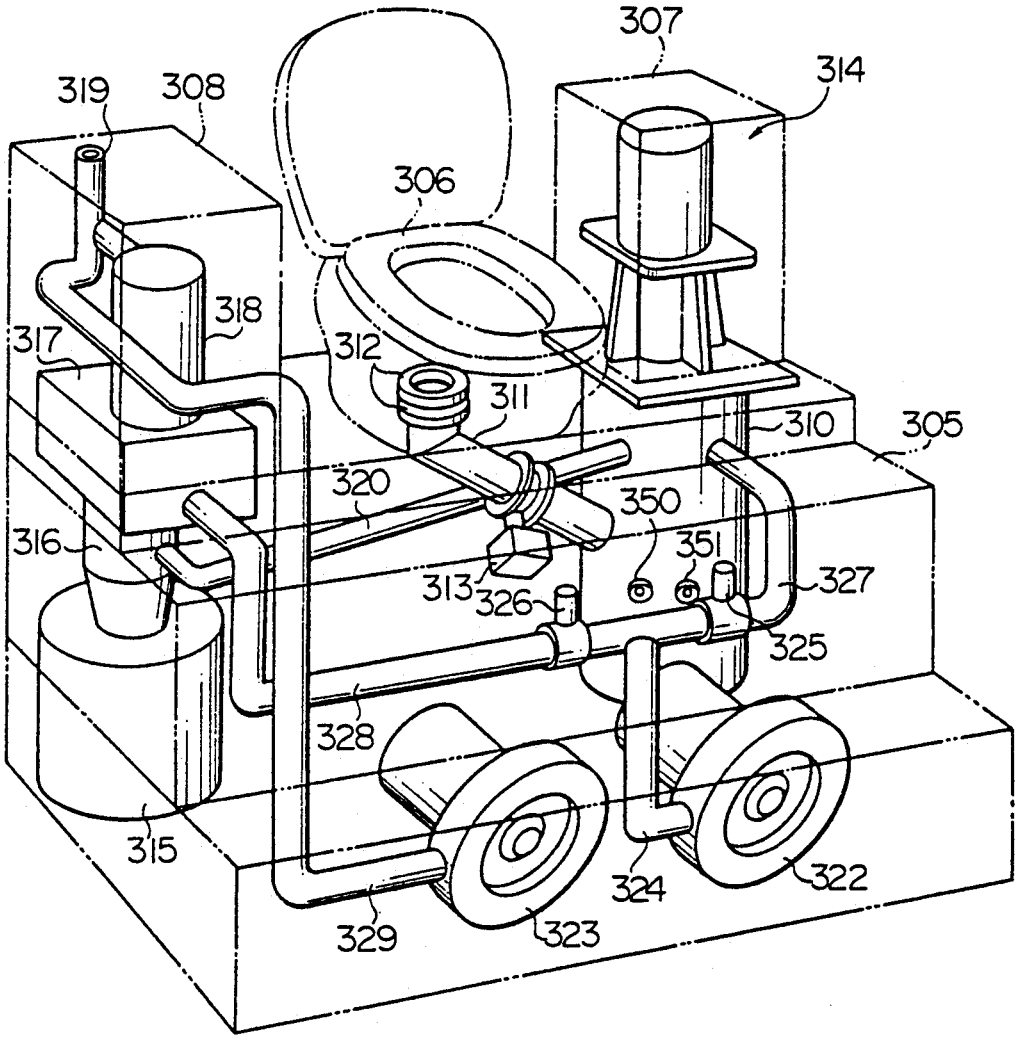
FIG. 15 is a schematic view showing the internal structure of the raw sewage disposal apparatus of FIG. 14.
Figure 16:
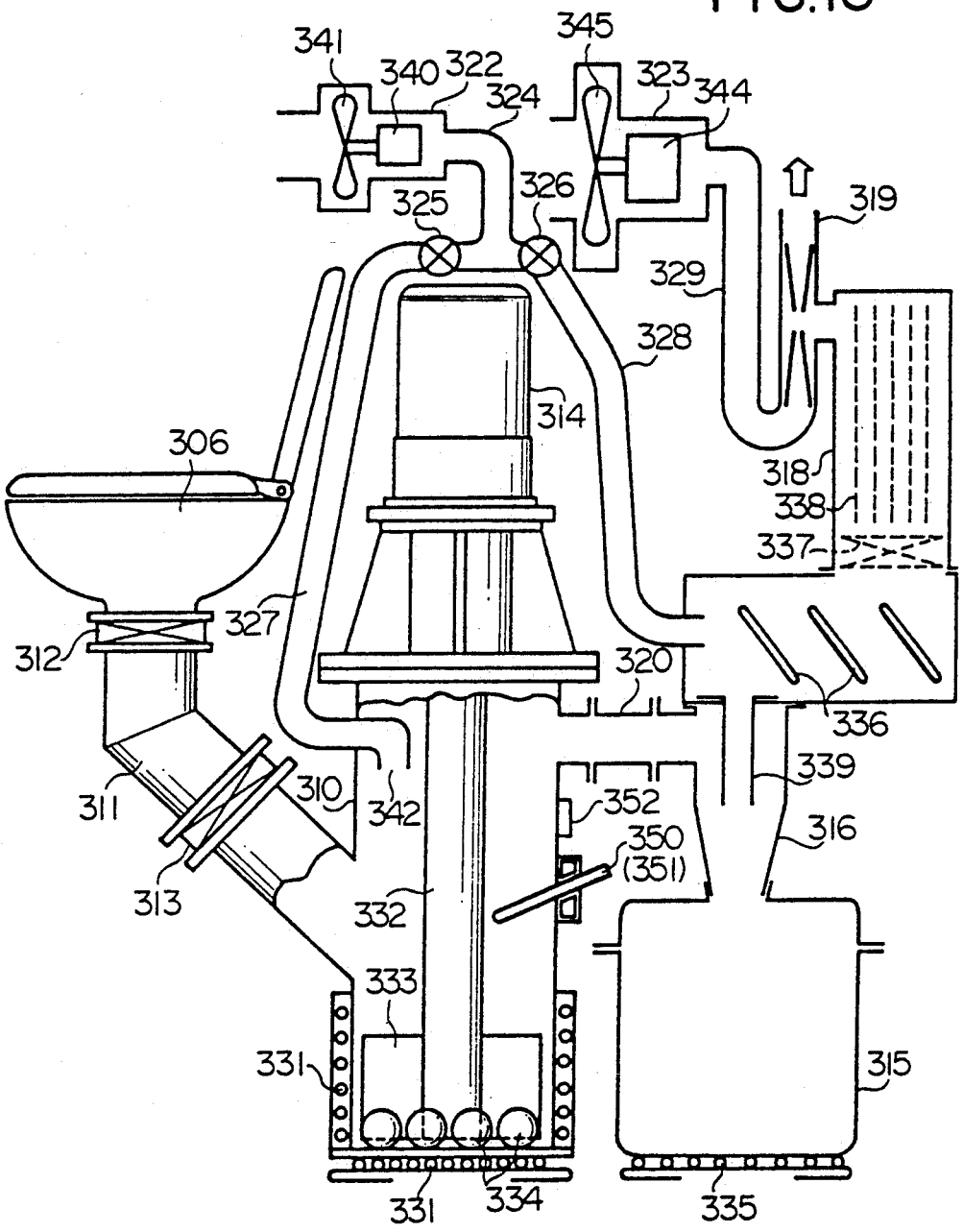
FIG. 16 is a view showing the piping system for connecting the components of the raw sewage disposal apparatus of FIG. 14.
Figure 17:
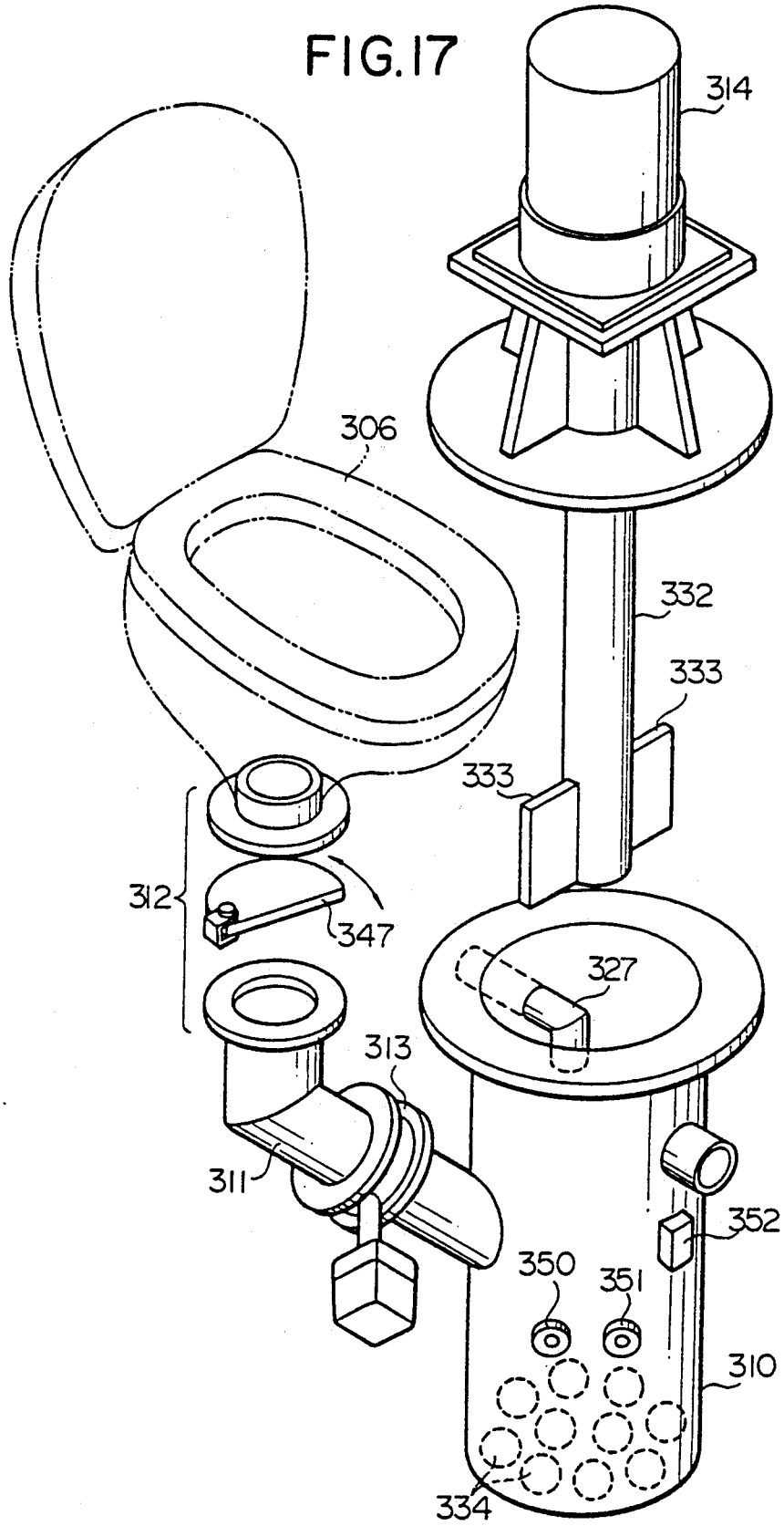
FIG. 17 is an exploded perspective view showing an evaporation cauldron and a stool, components of the raw sewage disposal apparatus of FIG. 14.

FIG. 10 shows an exploded perspective view illustrating the stool 206, the evaporation cauldron 210 and the introduction pipe 211.

In FIG. 10, a shutter plate 247 which is closable in a horizontal direction is supported inside the shutter 212. The horizontal motion of the shutter plate 247 makes the stool 206 communicate with the introduction pipe 211 or not.

The operation of the second embodiment will be described hereinafter.

Before disposing of the raw sewage by the raw sewage disposing apparatus 205, the raw sewage apparatus should be placed in the standby state.

At first, a start switch, not shown, is turned on to supply instructions to start the disposal operation by the raw sewage disposal apparatus 205. The heater 235 and the secondary heater 236 are energized to heat the dust collection box 215 and the secondary heat box 217. At the same time, only the motor 244 is driven so that the air supplied under high pressure by the air blower 223 is supplied to the ejector 219 by way of the air introduction pipe 229. The motor 240 is stopped. The first closing valve 225 is closed and the second closing valve 226 is opened. When the air flows at high speed in the ejector 219, the inside of the catalyst box 218 connected to the ejector 219 is negatively pressurized to thereby draw the air from inside the catalyst box 218 and direct it outside the catalyst box 218. Successively, by the negative pressure generated by the air passing the ejector 219 there is formed an air route through which the fresh air circulates in the air blower 222, the air introduction pipe 224, the second closing valve 226, the air introduction pipe 228, the secondary heat box 217 and the catalyst box 218. Accordingly, the fresh air is heated by the secondary heater 236 in the secondary heat box 217 whereby the hot air flows through the catalyst 238. As a result, the catalyst 238 is heated. At a low temperature, the catalyst does not effectively oxidize the oxidizable components of the discharge gas at all. It is necessary to warm the catalyst 238 at a given temperature for eliminating the bad smell.

When the raw sewage disposal apparatus 205 is in the standby state, the temporary toilet 201 can be used. When using the temporary toilet 201, the user opens the door 204 and excretes. The raw sewage is introduced into the evaporation cauldron 210 when the user presses a button, not shown. More in detail, when the user presses the button or a pedal after the stool 206 has been used, the shutter plate 247 in the shutter 212 moves so that the stool 206 is opened at the bottom thereof. Thereafter, the valve mechanism 213 is opened so that the raw sewage is successively introduced into the evaporation cauldron 210 by flowing along the inclined inner surface of the introduction pipe 211.

Then, the shutter 212 and the valve mechanism 213 are closed to thereby stop the communication between the stool 206 and the evaporation cauldron 210 so that the evaporation cauldron 210 is kept airtight. As a result, the bad smell from the evaporation cauldron 210 is prevented from flowing into the stool 216.

In the evaporating and drying operation, the heater 231 is energized, in synchronization with the operations of the shutter 212 and the valve mechanism 213, so that the evaporation cauldron 210 is heated at the bottom and the side periphery thereof. The liquid component of the raw sewage is heated to reach the boiling point. At the same time, the second closing valve 226 is closed and the first closing valve 225 is opened. At this time, the air blower 222 is not yet operated, hence another air route is formed through which the air drawn by the ejector 219 circulates in the stopped air blower 222, the air introduction pipe 224, the first closing valve 225, the air introduction pipe 227, the nozzle 242, the evaporation cauldron 210, the discharge pipe 220, the dust collector 216, the secondary heat box 217 and the catalyst box 218. With the formation of this route, the fresh air is always jetted by the nozzle 242 into the evaporation cauldron 210 to thereby facilitate the oxidation of the raw sewage to be dried.

When the motor in the drive mechanism 214 is actuated, the rotary shaft 232 is rotated and the stirring blades 233 are rotated at the portion adjacent to the bottom of the evaporation cauldron 210. At this time, the heat-holding bodies 234 are agitated by the stirring blades 233 at the portion adjacent to the bottom of the evaporation cauldron 210 to thereby stir the raw sewage. As a result, the raw sewage is mixed at a uniform temperature while the heat accumulated in the heat-holding bodies 234 is transmitted to the raw sewage therearound through the surfaces thereof. Since the heat-holding bodies 234 are spherical and have large surfaces, drying of the raw sewage is expedited and the liquid component thereof is forced to evaporate. The vapor formed by the evaporation of the liquid component is discharged from the discharge pipe 220 and introduced into the dust collector 216 and moves through a vortical path at high speed like a cyclone. The dust included in the evaporated liquid component is stored inside the dust collection box 215. A small amount of the liquid component is included in the dust. The liquid component included in the dust is evaporated again by the heat of the heater 235. The evaporated liquid water is introduced into the secondary heat box 217 from the pipe located in the center of the dust collector 216. Since the air is drawn toward the secondary heat box 217 due to the negative pressure in the ejector 219, the liquid component and the air including the bad smell evaporated in the evaporation cauldron 210 and the dust collection box 215 are introduced into the secondary heat box 217 and contact the secondary heater 236 and are heated to the temperature at which the catalyst 238 can perform its oxidation operation. Successively, the evaporated liquid component passes the filter 237 and contacts the catalyst 238 whereby the bad smell component in the evaporated liquid component is oxidized and decomposed. As a result, the bad smell component is changed into an odorless component. Thereafter, the air is drawn by the ejector 219 and diffused outside. In such a manner, the liquid component of the raw sewage in the evaporation cauldron 210 is successively evaporated and diffused into the atmosphere by the circulation of the air in the evaporation cauldron 210.

The liquid component which is the main component of the raw sewage stored in the evaporation cauldron 210 is evaporated by both the heat from the heater 231 and the stirring operations by the stirring blades 233 and the heat-holding bodies 234. The materials that remain last in the evaporation cauldron are mainly nonevaporable cellulosic substances. If these residual substances are allowed to accumulate in the evaporation cauldron 210, succeeding drying operations cannot be performed. Accordingly, every time the drying operation is completed, the residual substances and the dust should be removed and thereafter the evaporation cauldron should be cleaned. The cleaning operation can be effected automatically when it is judged that all the raw sewage in the evaporation cauldron is dried.

Figure 2:
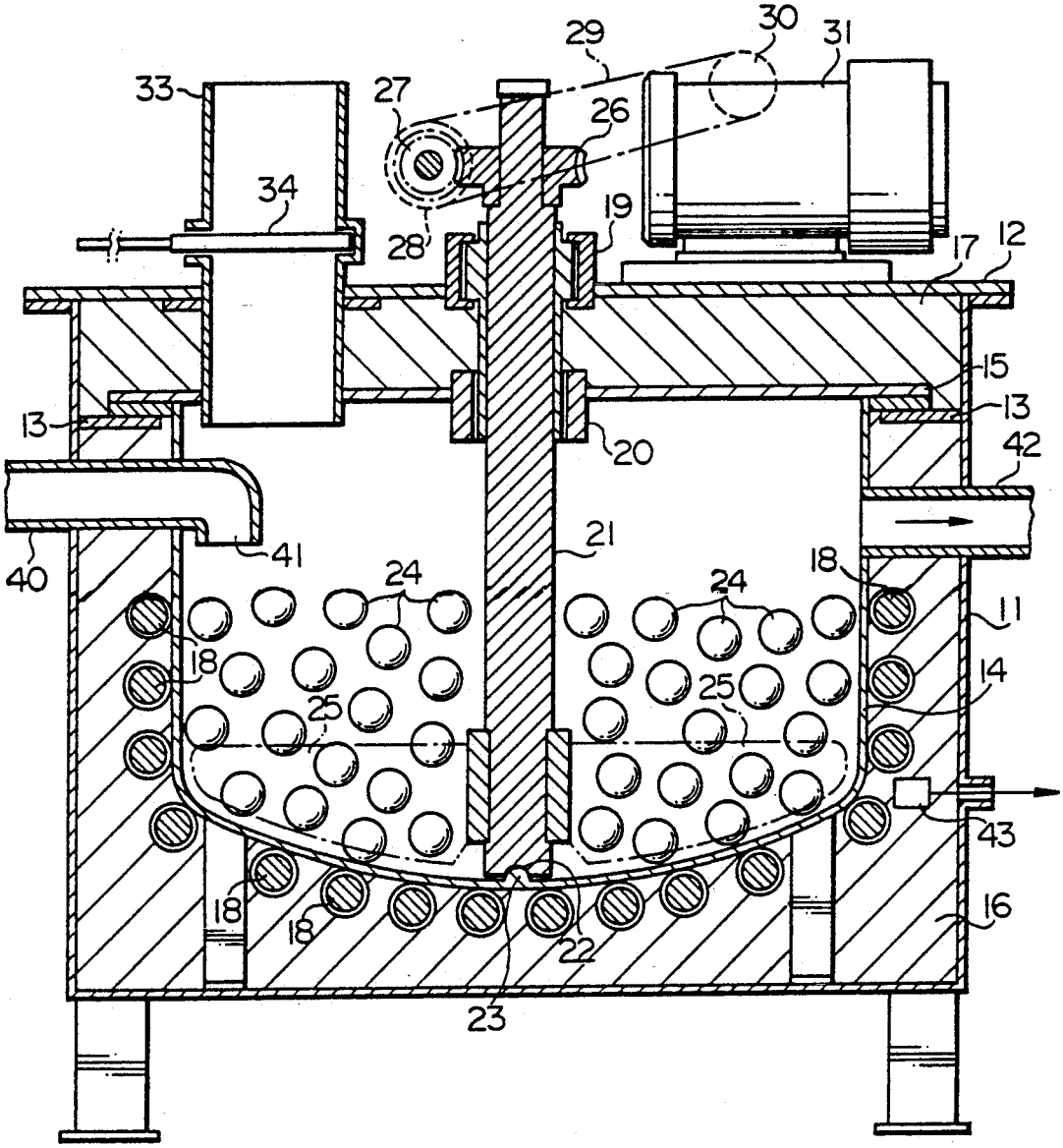
FIG. 2 is a cross-sectional view showing the internal structure of the raw sewage disposal apparatus of FIG. 1.

When the liquid component of the raw sewage has been discharged from the evaporation cauldron 210, the temperature of the peripheral surface of the evaporation cauldron 210 rises and this is detected by a temperature sensor (not shown), for example, like the sensor 43 in FIG. 2. As a result, it is judged that the drying operation is completed. Based on this judgment, the motor of the air blower 222 is actuated to drive the fan 241 so that the fresh air is forced to flow, under high pressure, through the air introduction pipe 224, the first valve 225 which is now open and the air introduction pipe 227. The air is jetted toward the inside of the evaporation cauldron by the nozzle 242. As a result, the dust and the residual substances in the evaporation cauldron are blown up in the form of fine particles. At this time, the drive mechanism 214 is continuously operated to thereby agitate the heat-holding bodies 234 at the portion adjacent to the bottom of the evaporation cauldron 210 whereby the nonevaporated residual substances are crushed minutely. The dust and the residual substances blown up by the air jetted by the nozzle 242 are supplied to the dust collector 216 from the discharge pipe 220. The dust in the dust collector 216 drops into the dust collection box 215 and is thereby separated from the air. The separated air is discharged outside apparatus 201 through the secondary heat box 217 and the catalyst box 218. With the series of these operations, the evaporation cauldron 210 is cleaned every time the contents of the cauldron 210 are dried.

After the cleaning operation is completed, the residual substances accumulate in the dust collection box 215. The dust collection box 215 is removed regularly from the raw sewage disposal apparatus 205 whereby the dust and the residual substances are disposed of. As a result, the raw sewage disposal apparatus 205 can be used for a long period of time.

After the residual substances in the evaporation cauldron 210 have been removed therefrom by the air under pressure from the air blower 222, the stool 206 is returned to the standby state for the next user. At this time, the motor 240 is stopped to thereby stop the air flow. At the same time, the first closing valve 225 is closed and the second closing valve 226 is opened. The heater 231 is deenergized so that the evaporation cauldron 210 is not heated and the drive mechanism 214 is stopped to thereby stop the rotation of the rotary shaft 232.

However, the motor 244 is driven to rotate the fan 245 while the heater 235 and the secondary heater 236 are energized. Accordingly, the air drawn by the ejector 219 is circulated in the secondary heat box 217 and the catalyst box 218 through the stopped air blower 222, air introduction pipe 224, the second closing valve 226 and the air introduction pipe 228. The air circulation is continued for preventing the temperature in the catalyst 238 from being reduced and for rendering the raw sewage disposal apparatus 205 to be in a standby condition for the next drying operation. If the stool 206 is not used for a fixed period of time, the heaters 235 and 236 are deenergized while the air blower 244 is in standby after the pipes are cooled. When the raw sewage disposing apparatus 205 is actuated again, the user turns on a completion switch in the stool 206 whereby the series of operations are started at the state where the raw sewage disposal apparatus 205 is kept warm.

As described in detail above, the introduction pipe 211 is inclined relative to the evaporation cauldron 210 and is connected at one end thereof to the side surface of the evaporation cauldron and at the other end thereof to the stool. Accordingly, the length of the introduction pipe is increased whereby a plurality of shutters can be disposed at the introduction pipe. As a result, the evaporation cauldron can be airtightly closed so that the bad smell generated in the evaporation cauldron can be prevented from flowing toward the stool.

Furthermore, the stool is not necessarily disposed over the evaporation cauldron, it is possible to install the stool at a low position so that the user is not required to sit on a stool located at the high position, which facilitates the use thereof.

Third Embodiment (FIGS. 14 to 24)

A raw sewage disposal apparatus according to the third embodiment will be described with reference to FIGS. 14 to 24.

The raw sewage disposal apparatus according to the third embodiment is substantially the same as that of the second embodiment. Accordingly, described hereinafter are mainly the structural features and the operational procedures of the raw sewage disposal apparatus which are different from those of the second embodiment.

The parts in FIGS. 14 to 24 which correspond to parts in FIGS. 7–13 are identified by reference numerals which begin with the digit "3" and the last two digits are the same as the last two digits for the same part in FIGS. 7–13.

A raw sewage disposal apparatus 305 comprises a drying mechanism, a blowing mechanism, a dust collection mechanism and a catalyst mechanism.

An air introduction pipe 329 is connected at one end thereof to an air blower 323 and at the other end thereof to a lower end of an ejector 319.

Figure 18:
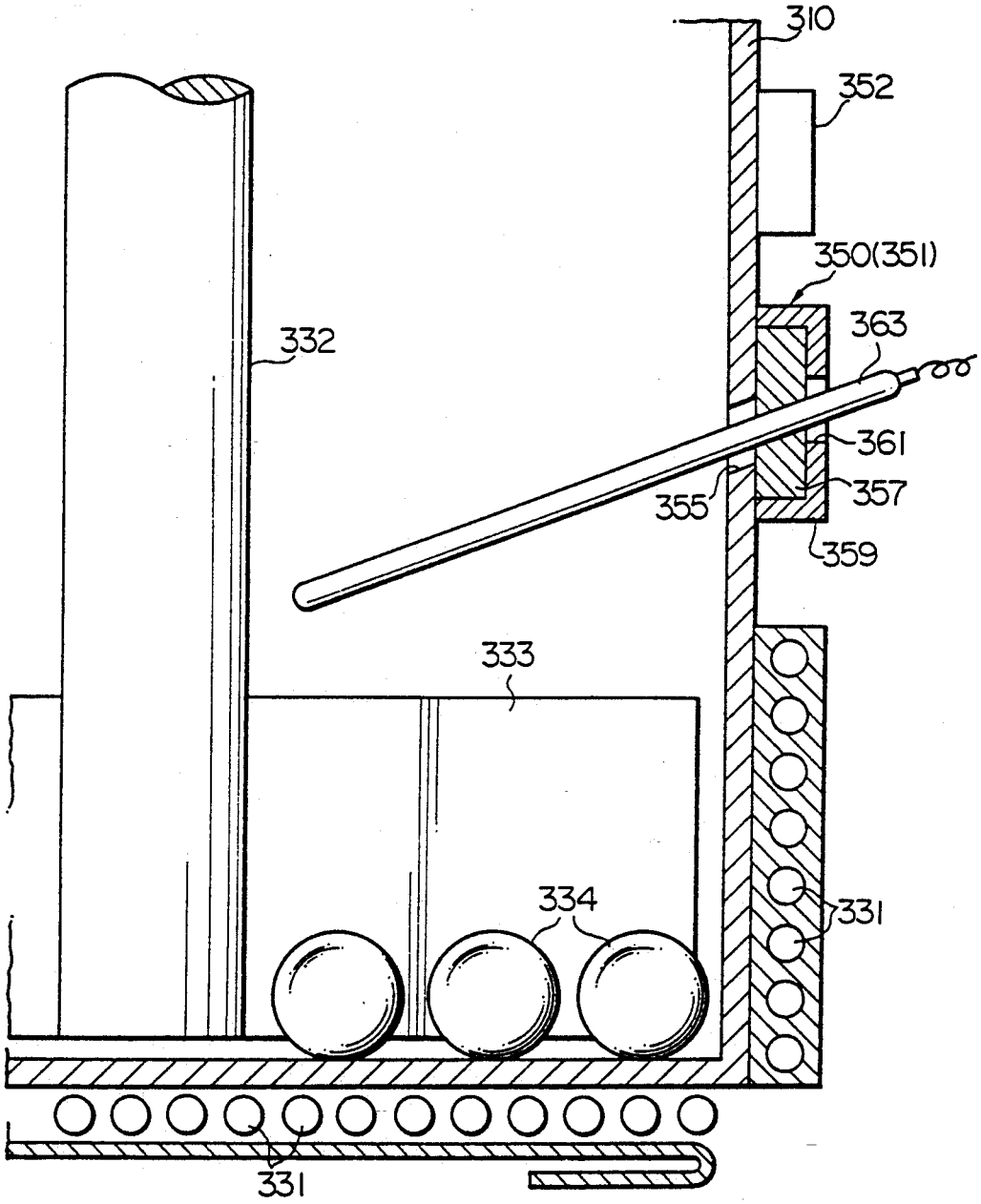
FIG. 18 is a vertical cross-sectional view showing a liquid level detecting means, a component of the raw sewage disposal apparatus of FIG. 14.
Figure 19:
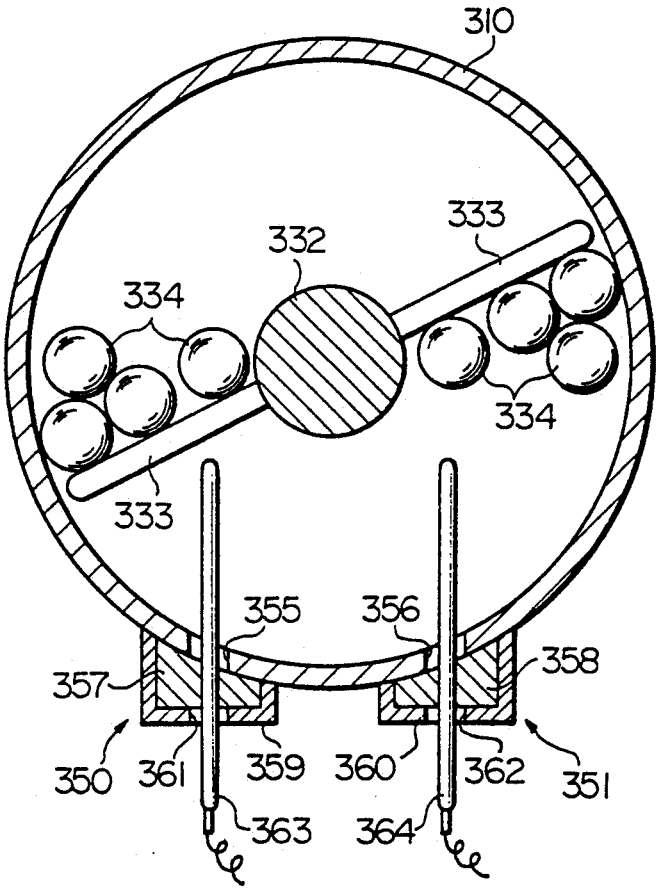
FIG. 19 is a lateral cross-sectional view showing the liquid level detecting means of FIG. 18.

An evaporation cauldron 310 has liquid level detecting sensors 350 and 351, respectively, fixed to a central side surface thereof. The liquid level detecting sensors 350 and 351 are attached to the outer periphery of the evaporation cauldron 310. The evaporation cauldron 310 has a temperature sensor 352 fixed at the outer periphery thereof for measuring the temperature in the evaporation cauldron 310. The liquid level detecting sensors 350 and 351 will be described more in detail with reference to FIGS. 18 and 19 in which FIG. 18 is a vertical cross-sectional view of the liquid level detecting sensor 350 (351) and FIG. 19 is a lateral cross-sectional view of the liquid level detecting sensors 350 and 351.

The evaporation cauldron 310 has two ports 355 and 356 through the side surface thereof at a predetermined vertical height. Retaining bodies 357 and 358 have cupshaped metal fittings 359 and 360 which are fixed to the periphery thereof. The metal fittings 359 and 360 are fixed to the evaporation cauldron 310 by a screw or the like so as to be detachable therefrom. Openings 361 and 362 are defined at the outside surfaces of the metal fittings 359 and 360 and are positioned coaxially with the introduction ports 355 and 356. Contact detecting rods 363 and 364, respectively, formed of electrically conductive materials are inserted inside the evaporation cauldron 310 so as to penetrate the openings 361 and 362, the retaining bodies 357 and 358 and the introduction ports 355 and 356. The contact detecting rods 363 and 364 are formed of, for example, conductive materials, such as copper or the like, and they are disposed in parallel with each other so as to be slightly inclined relative to the bottom of the evaporation cauldron 310 as shown in FIG. 18. Since the contact detecting rods 363 and 364 are fixed to the retaining bodies 357 and 358 so as not to contact the metal fittings 359 and 360, they are electrically insulated therefrom. As shown in FIG. 19, the contact detecting rods 363 and 364 are positioned on opposite lateral sides of a rotary shaft 332 and are disposed so as not to contact the rotary shaft 332.

Figure 20:
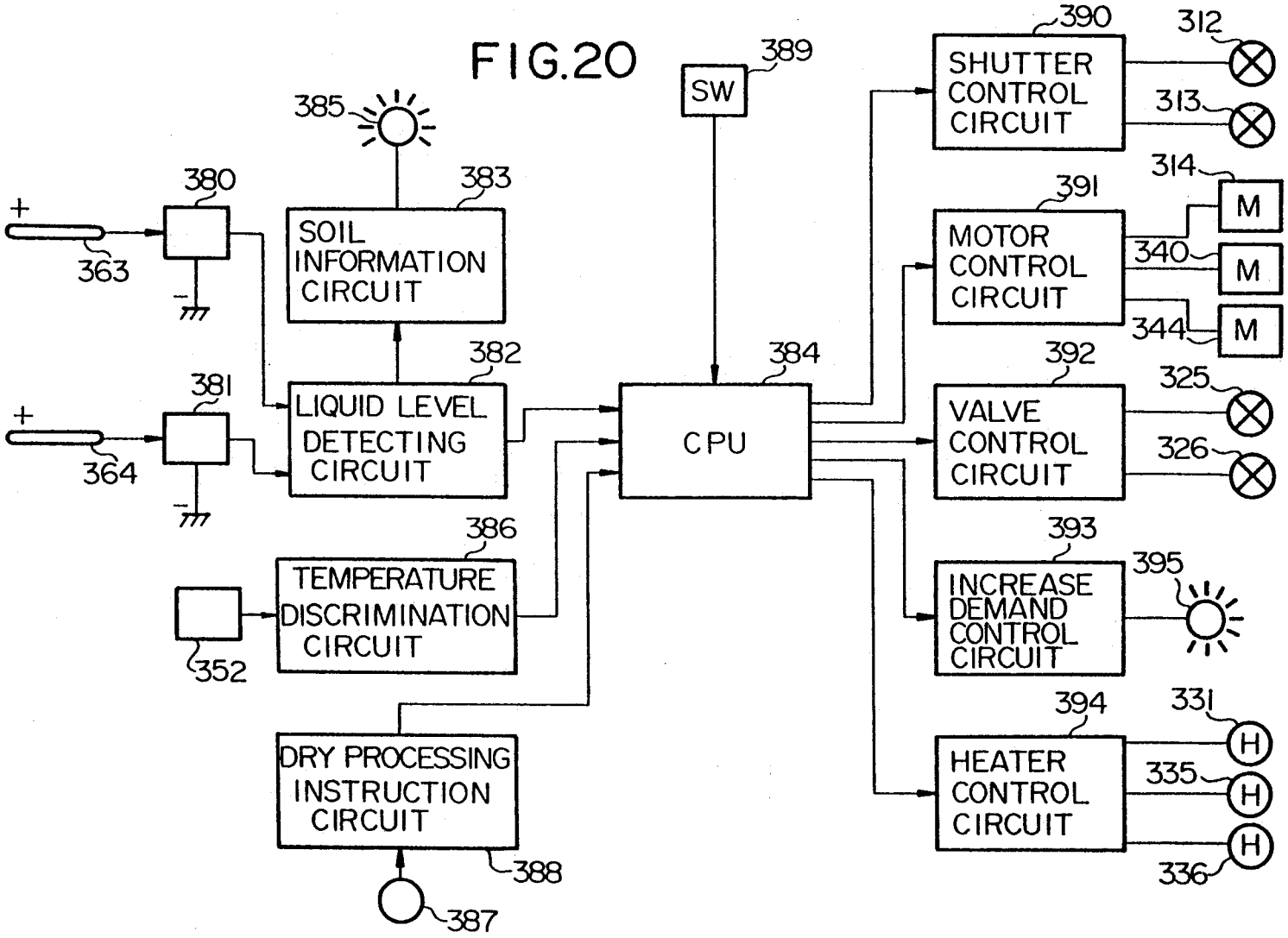
FIG. 20 is a block diagram showing a control system of the raw sewage disposal apparatus of FIG. 14.
Figure 21:
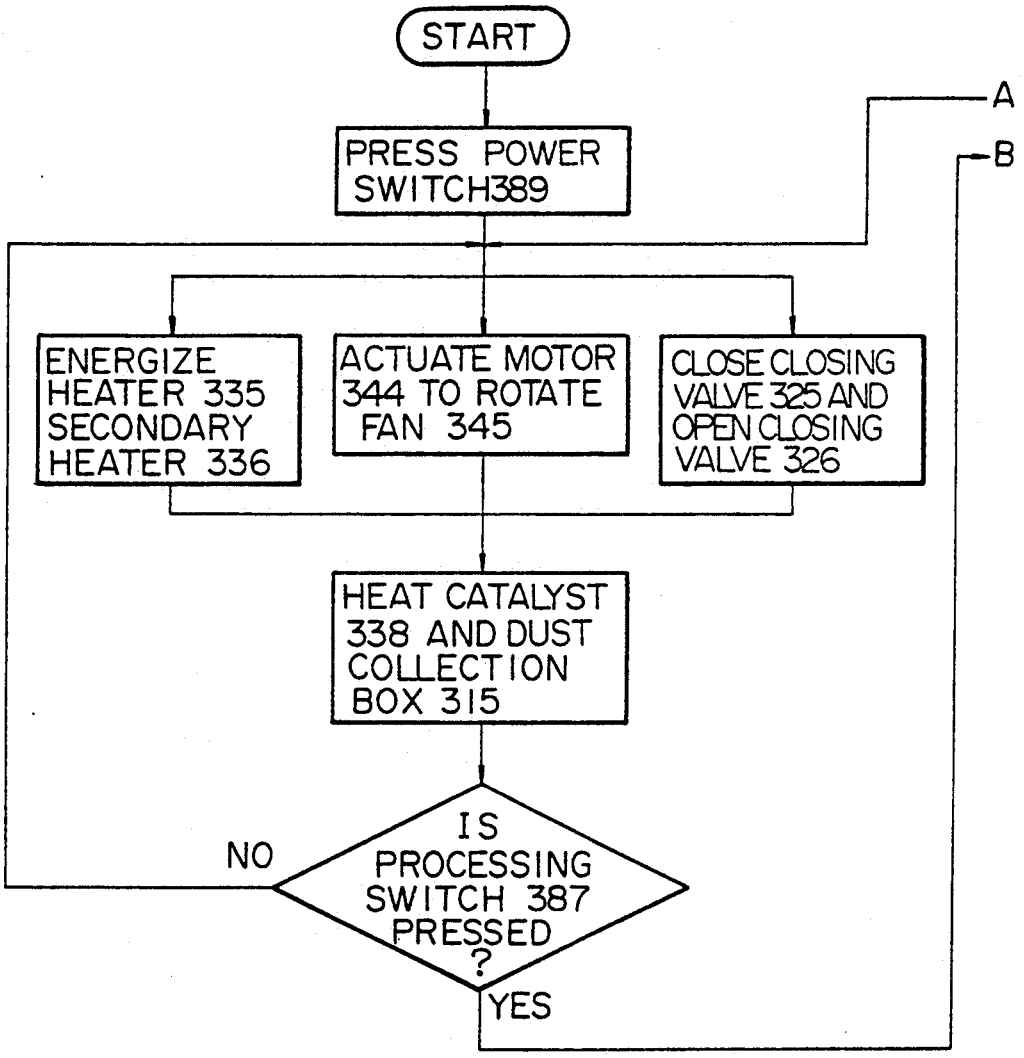
FIGS. 21 to 24 are views showing the operation of the raw sewage disposal apparatus of FIG. 14.
Figure 22:
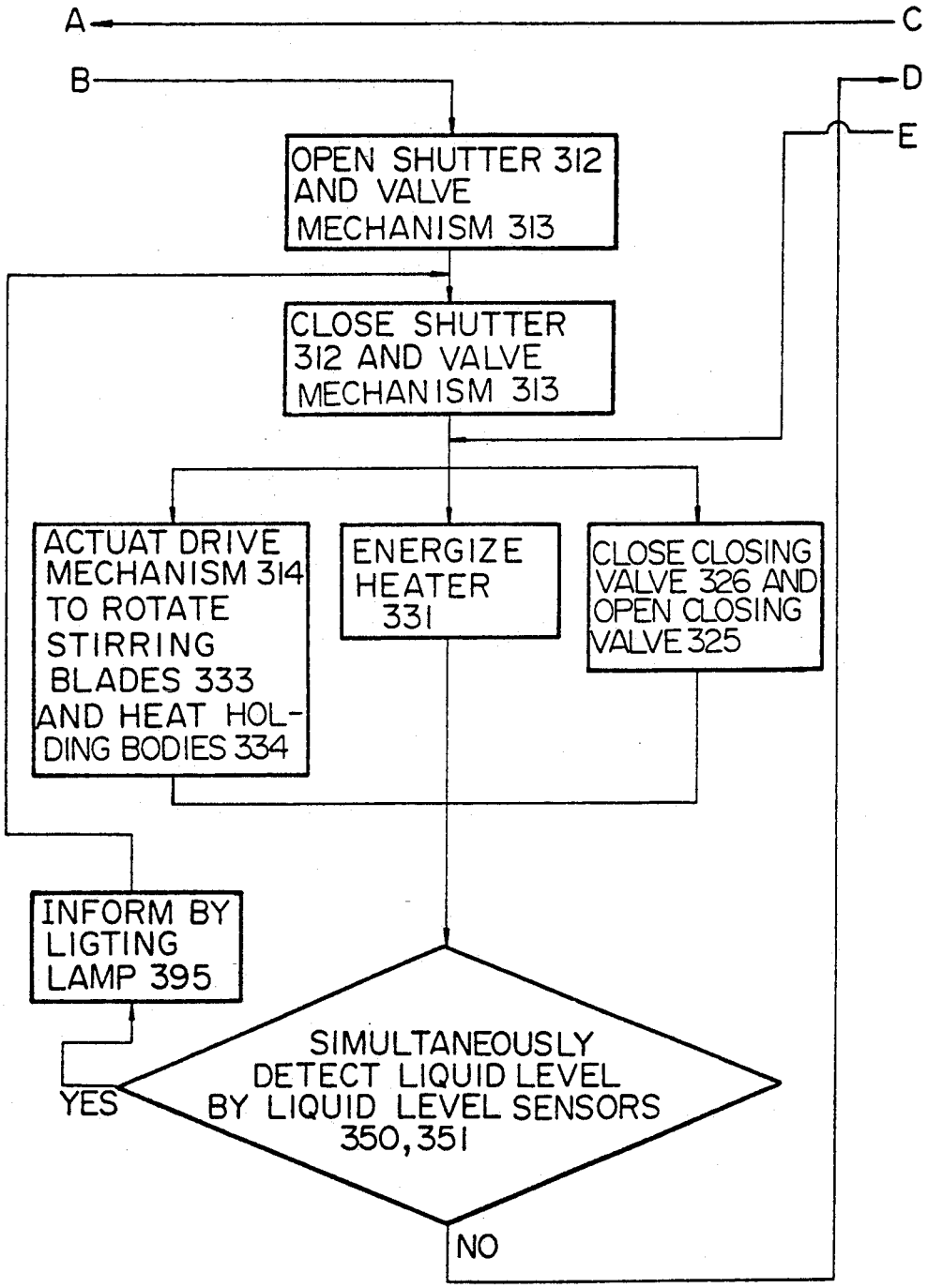
Figure 23:
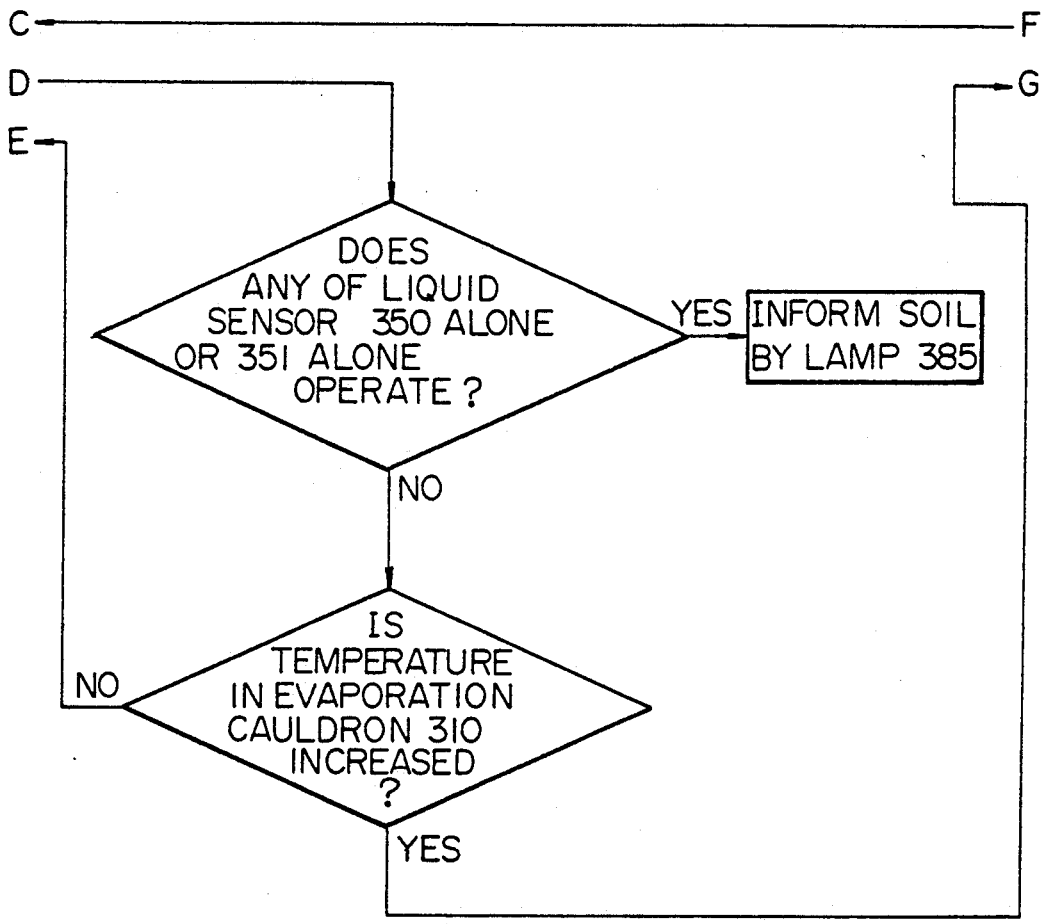
Figure 24:
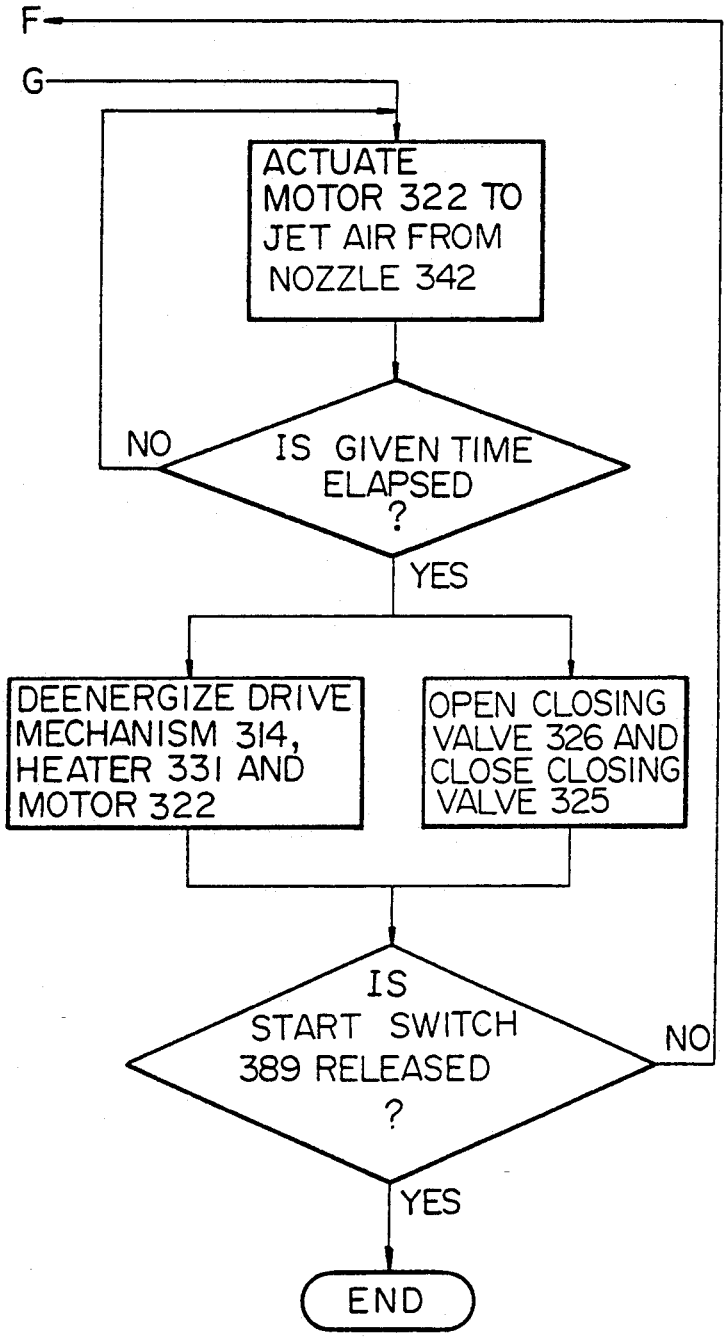
Figure 25:
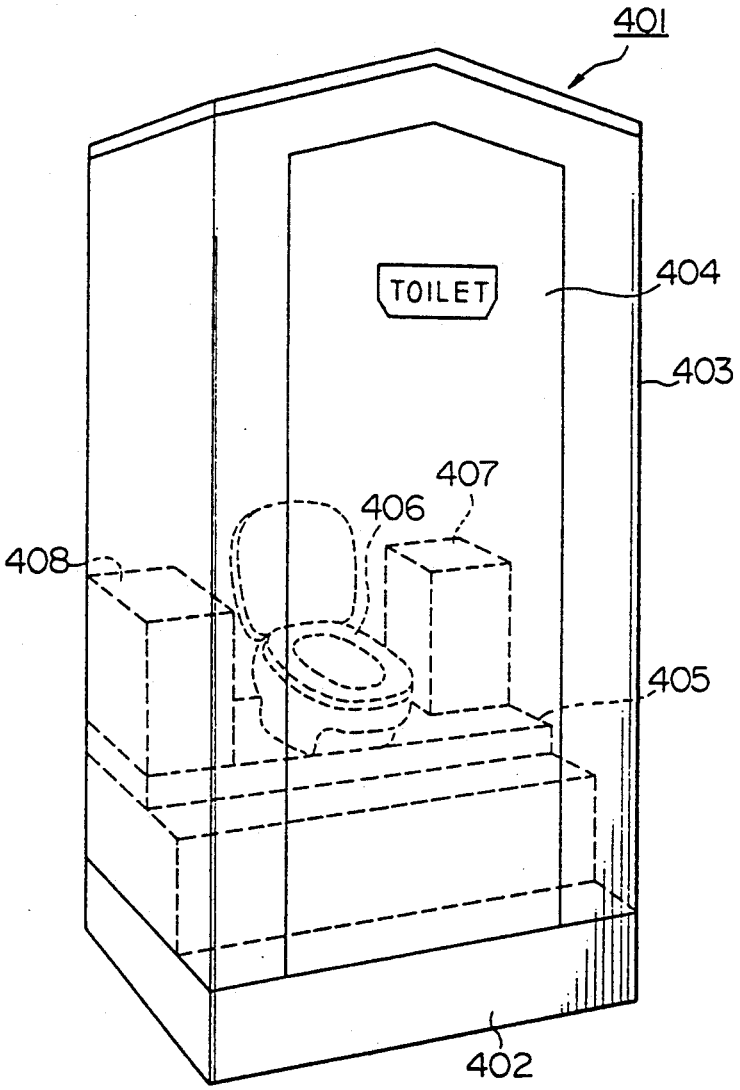
FIG. 25 is a perspective view of a temporary toilet having a raw sewage disposal apparatus therein, according to a fourth embodiment of the present invention.
Figure 26:
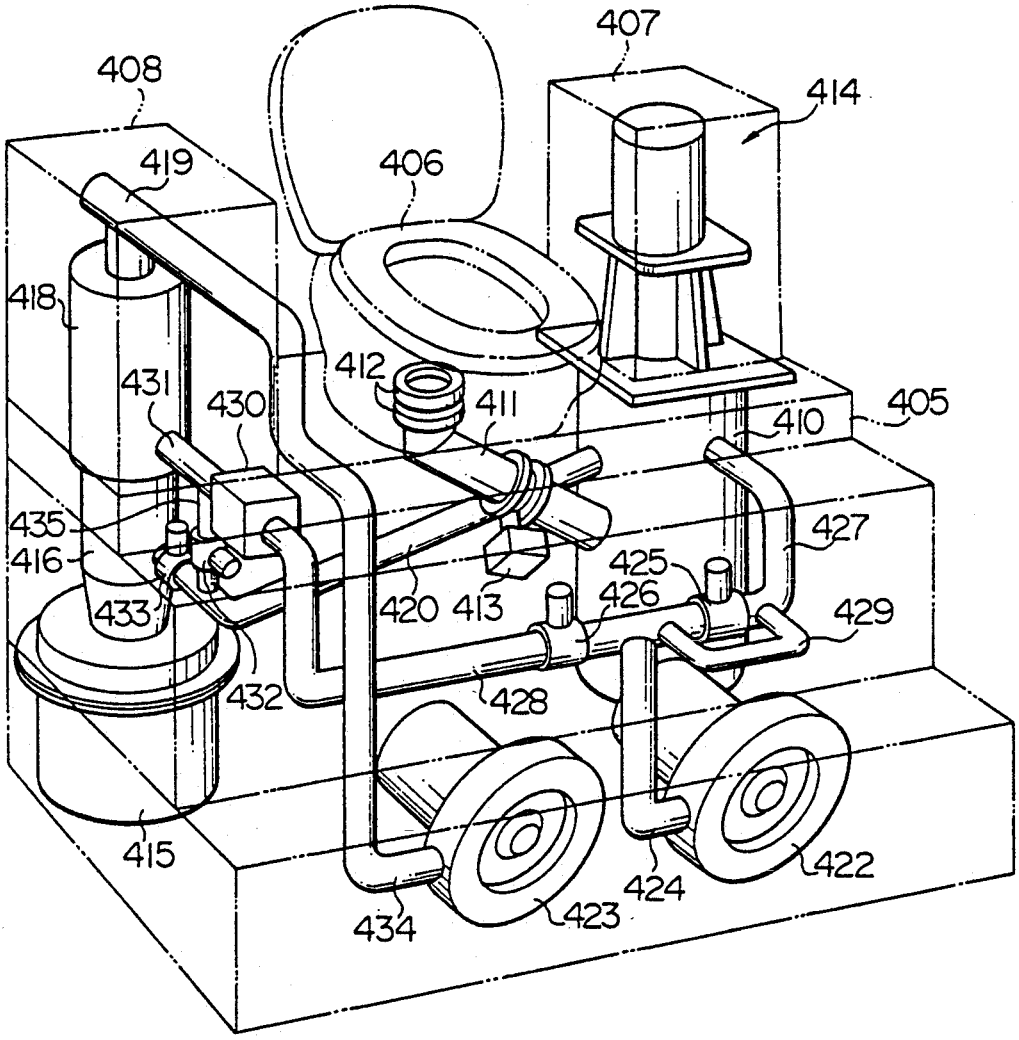
FIG. 26 is a schematic view showing the internal structure of the raw sewage disposal apparatus of FIG. 25.
Figure 27:
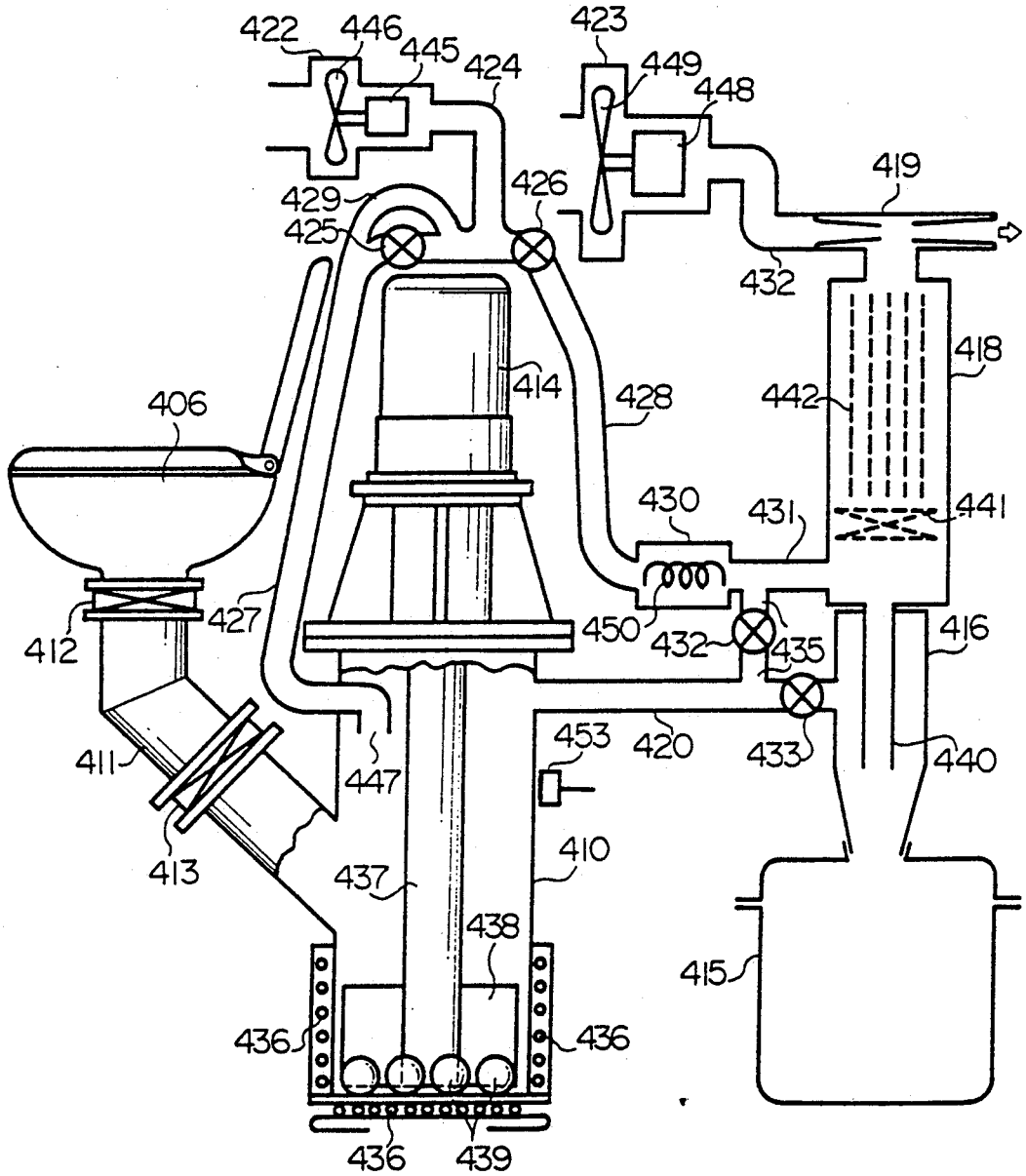
FIG. 27 is a view showing the piping system for connecting the components of the raw sewage disposal apparatus of FIG. 25.
Figure 28:
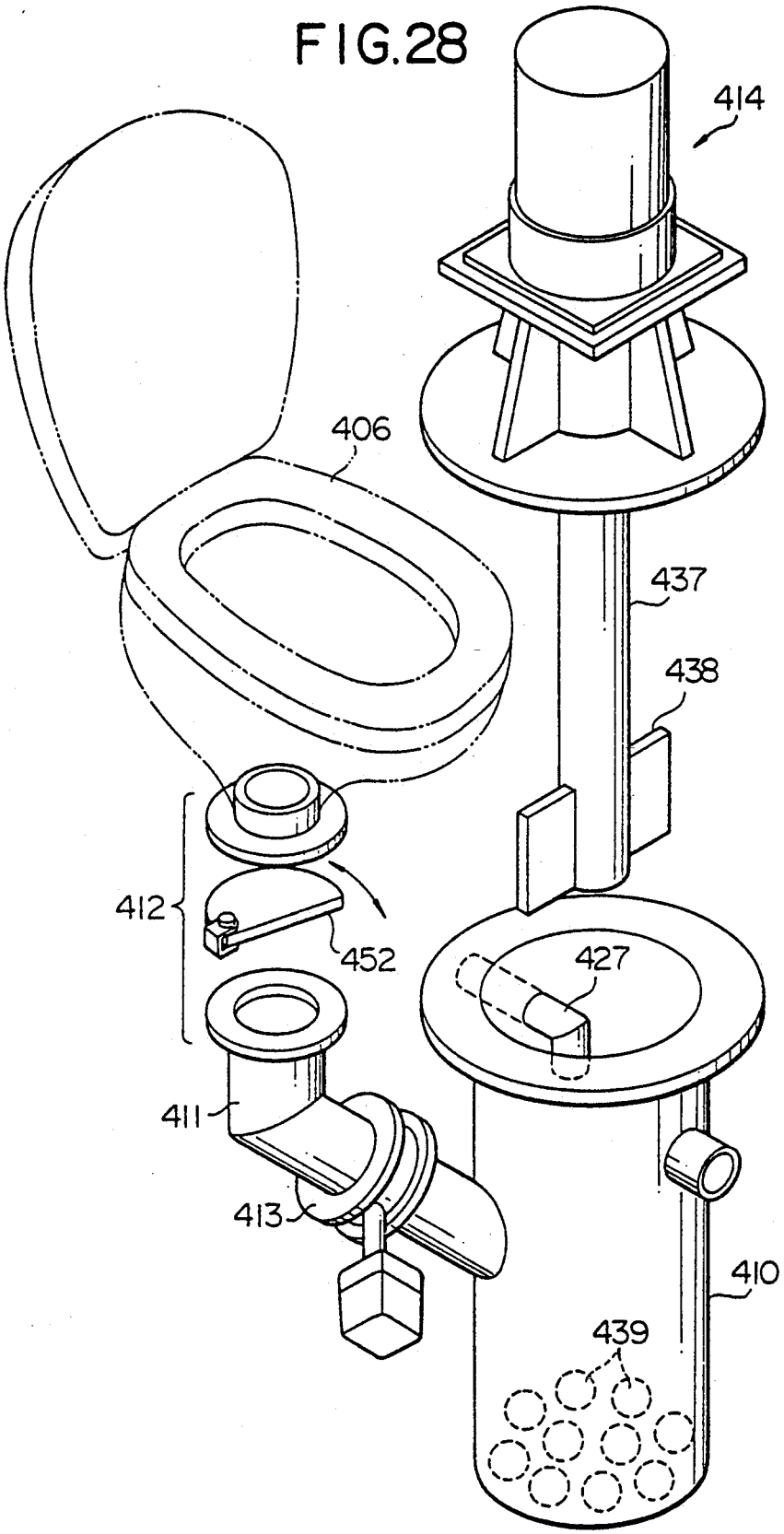
FIG. 28 is an exploded perspective view showing an evaporation cauldron and a stool, components of the raw sewage disposal apparatus of FIG. 25.

FIG. 20 is a block diagram of an electric circuit for controlling the entire arrangement of the raw sewage disposal apparatus 305.

The contact detecting rods 363 and 364 are respectively connected to conduction detecting circuits 380 and 381 having an amplifier circuit therein for discriminating the conductive state of the evaporation cauldron 310 by the variation of the resistance value. The conduction detecting circuits 380 and 381 are connected to liquid level detecting circuit 382 at the inputs thereof. One output of the liquid level detecting circuit 382 is connected to a soil information circuit 383 at one output thereof and the other output is connected to a central processing unit (CPU) 384. The soil information circuit 383 is connected to an alarm lamp 385 for informing the operator about anomalous operation of the contact detecting rods 363 and 364. An output of the temperature sensor 352 is supplied to a temperature discrimination circuit 386, an output of which is connected to the CPU 384. When the user of the temporary toilet 301 presses a button after use of the stool 306, an output of a disposal switch 387 for instructing the disposal of the raw sewage is connected to a dry processing instruction circuit 388, an output of which is connected to CPU 384. Connected to the CPU 384 is a power switch 389 for instructing the start of the raw sewage disposal apparatus 305.

The CPU 384 issues control output signals which are respectively supplied to a shutter control circuit 390, a motor control circuit 391, a valve control circuit 392, an increase demand control circuit 393 and a heater control circuit 394. A shutter 312 and a valve mechanism 313 are respectively connected to the shutter control circuit 390 for controlling the closing operations thereof. A drive mechanism 314 and motors 340 and 344 are respectively connected to the motor control circuit 391. First and second closing valves 325 and 326 are respectively connected to the valve control circuit 392. A lamp 395 for indicating the increase demand is connected to the increase demand control circuit 393. Heaters 331 and 335 and a secondary heater 336 are respectively connected to the heater control circuit 394.

The operation of the raw sewage disposal apparatus according to the third embodiment will be described hereinafter.

To start the raw sewage disposal apparatus 305, the power switch 389 is turned on to thereby actuate the CPU 384. The CPU 384 issues instruction signals which are supplied to all the circuits. More in detail, the CPU 384 supplies the signal to the heater control circuit 394 to thereby energize the heater 335 and the secondary heater 336 so that a dust collection box 315 and a secondary heat box 317 are respectively heated. The CPU 384 supplies the signal to the motor control circuit 391 to thereby drive the motor 344 alone so that the air is forced to be supplied under high pressure to the ejector 319 through the air introduction pipe 329. The motor 340 is kept stopped and the drive mechanism 314 is also stopped. Furthermore, the first closing valve 325 is closed and the second closing valve 326 is opened by the valve control circuit 392.

In this standby state, when the fresh air is forced to be supplied from the air blower 323 into the ejector 319, the catalyst box 318 is negatively pressurized so that the air in the catalyst box 318 is drawn outside the catalyst box 318. The negative pressure generated by the air flowing in the ejector 319 forms an air route through which the air flows in the stopped air blower 322, the air introduction pipe 324, the second closing valve 326, the air introduction pipe 328, the secondary box 317 and the catalyst box 318. The fresh air introduced into the secondary heater box 317 is heated by the secondary heater 336 and the thus heated air flows into the catalyst box 318 so that the catalyst 338 is heated. The standby operation is continued until the disposing switch 387 is pressed.

After use of a temporary toilet 301, the same toilet should be cleaned for use by the next user. According to the third embodiment, the cleaning operation can be made by manually pressing the disposal switch 387 after the use of the temporary toilet 301. When the disposal switch 387 is closed, the raw sewage is introduced into the evaporation cauldron 310. At the same time, when the disposal switch 387 is closed, the dry processing instruction circuit 388 supplies a signal to the CPU 384. The CPU 384 supplies, upon reception of the signal from the dry processing instruction circuit 388, the same signal to the shutter control circuit 390. The shutter 312, upon reception of the signal from the CPU 384, moves a shutter 347 so that the stool 306 is opened at the bottom thereof. Accordingly, the raw sewage accumulated at the bottom of the stool 306 is dropped into the introduction pipe 311. At the same time, the valve mechanism 313 is opened upon reception of the instruction from the shutter control circuit 390 so that the raw sewage is introduced into the evaporation cauldron 310 along the inclined surface of the introduction pipe 311.

Each mechanism is closed after the shutter 312 and the valve mechanism 313 are respectively opened by the instruction of the shutter control circuit 390 for a fixed period of time whereby the communication between the stool 306 and the evaporation cauldron 310 is shut off. This is made for preventing the bad smell generated in the evaporation cauldron 310 from flowing back to the stool 306.

In the drying and evaporation operations, the heater 331 is energized in synchronization with the operations of the shutter 312 and the valve mechanism 313 so that the heater 331 heats the bottom and the lower periphery of the evaporation cauldron. The raw sewage in the evaporation cauldron is heated at the boiling temperature. At the same time, the second closing valve 326 is closed and the first closing valve 325 is opened by the valve control circuit 392. Even when the first closing valve 325 and the second closing valve 326 are selectively switched, the output of the motor control circuit 392 is not varied so that the motor 340 in the air blower 322 is not actuated. Accordingly, the negative pressure generated by the air flowing in the ejector 319 forms another air route through which the air flows in the stopped air blower 322, the air introduction pipe 324, the first closing valve 325, the air introduction pipe 327, the nozzle 342, the evaporation cauldron 310, the discharge pipe 320, the dust collector 316, the secondary heater box 317 and the catalyst box 318. The fresh air is always jetted by the nozzle 342 into the evaporation cauldron 310 due to this route, which facilitates the oxidation of the heated raw sewage.

The motor control circuit 391 operates the motor in the drive mechanism 314, thereby rotating the rotary shaft 332 whereby stirring blades 333 are rotated at the portion adjacent to the bottom of the evaporation cauldron 310. A plurality of heat-holding bodies 334 are agitated at the portion adjacent to the evaporation cauldron 310 so that the raw sewage is stirred. As the succeeding sequential operations continue in the same manner as those of the second embodiment, the raw sewage is successively dried and the vaporized liquid is diffused outside the raw sewage disposing apparatus 305.

The raw sewage introduced from the stool 306 into the evaporation cauldron 310 rises to a predetermined level in the evaporation cauldron 310. When the power switch 389 is turned on, positive current is applied to the contact detecting rods 363 and 364 while the evaporation cauldron 310 per se is grounded, namely, a negative current is applied to the evaporation cauldron 310. When the raw sewage is introduced into the evaporation cauldron 310, the liquid level rises in proportion to the amount of the raw sewage so that the liquid level approaches gradually to the contact detecting rods 363 and 364. If the amount of the raw sewage is under the predetermined level, the positive current from the contact detecting rods 363 and 364 is not applied to the evaporation cauldron 310 by way of the raw sewage in the evaporation cauldron 310. However, if the amount of the raw sewage exceeds the predetermined level, the liquid level rises over a reference value, i.e., the drying capacity, whereby the liquid contacts the contact detecting rods 363 and 364. Since the principal ingredient of the raw sewage comprises the liquid component, the evaporation cauldron 310 becomes conductive even if there is some resistance between the evaporation cauldron 310 and the contact detecting rods 363 and 364. Since the positive current is applied to the contact detecting rods 363 and 364 and the negative current is applied .to the evaporation cauldron 310, a small amount of current is applied to both the contact detecting rods 363 and 364 and the evaporation cauldron 310. The small amounts of current are amplified by conduction detecting circuits 380 and 381 whereby the conductive states between them are discriminated.

When the conduction detecting circuits 380 and 381 discriminate the conductive state, they discriminate that the amount of the raw sewage in the evaporation cauldron exceeds the predetermined amount to be disposed of, i.e., disposing capacity, and they issue signals. These signals are supplied to the liquid level detecting circuit 382. The liquid level detecting circuit 382 judges that the amount of the raw sewage in the evaporation cauldron exceeds the predetermined disposing capacity, namely, the liquid component exceeds the predetermined level, when it receives the signals from both the conduction detecting circuits 380 and 381 and it issues a signal. The signal is supplied to the CPU 384. The CPU 384 issues signals, upon reception of the signal from the liquid level detecting circuit 382, which are supplied to the shutter control circuit 390 and the increase demand control circuit 393 so that the shutter 312 and the valve mechanism 313 are kept closed to prevent the raw sewage from being introduced from the stool 306.

At the same time, the increase demand control circuit 393 lights a lamp 395 which informs the operator that an amount of raw sewage exceeding the amount that can be disposed of, is being introduced into the evaporation cauldron 310. Lighting of the lamp 395 signifies that the raw sewage disposal apparatus 305 cannot dispose of anymore raw sewage and an additional raw sewage disposing apparatus 305 is needed. When the lamp 395 is continually lighted, the raw sewage disposing apparatus 305 is being used by many users to an extent that exceeds the predetermined disposing capacity. Accordingly, another portable toilet provided with the raw sewage disposal apparatus having the same disposing capacity shall be installed to meet the demand of the users.

During the time that the contact detecting rods 363 and 364 detect that the liquid level exceeds the predetermined one, the shutter 312 and the valve mechanism 313 are kept closed and the evaporation cauldron 310 continues the drying and evaporating operations.

As mentioned above, the contact detecting rods 363 and 364 always monitor the liquid level in the evaporation cauldron 310, for judging an erroneous operation when only one of the contact detecting rods 363 and 364 is operated and discriminating the liquid level only when the two contact detecting rods 363 and 364 are operated to thereby correctly indicate that the liquid component exceeds the predetermined level. However, there is a likelihood that the soil will become attached to the contact detecting rods 363 and 364 to thereby prevent the insulation from keeping when the raw sewage disposing apparatus 305 is used for a long period of time. In such a state, the liquid level cannot be correctly measured, which causes the erroneous operation of the liquid level detecting circuit 382. Accordingly, when one of the contact detecting rods 363 and 364 of the liquid level detecting sensors 350 and 351 is conductive, the liquid level detecting sensors 350 and 351 judge that soil is attached to the surfaces of the contact detecting rods 363 and 364 and the cleaning thereof is necessitated. That is, when the liquid level detecting circuit 382 judges that soil is attached to the surfaces of the contact detecting rods 363 and 364 when a predetermined time elapsed, and issues a signal when one of the conduction deleting circuits 380 and 381 continue to issue a signal representing that the liquid level exceeds a predetermined level. The signal is supplied to the soil information circuit 383. The soil information circuit 383 lights the lamp 385 indicating that one of the contact detecting rods 363 and 364 is soiled, which informs the operator so that the operator can start the cleaning operation quickly. The operator reads the lighting of the lamp 385 at the time of the maintenance and removes the metal fittings 359 and 360 from the side surfaces of the evaporation cauldron 310 and extracts the contact detecting rods 363 and 364 from the evaporation cauldron 310 and thereafter cleanses the outer peripheries of the contact detecting rods 363 and 364 and the introduction ports 355 and 356. The contact detecting rods 363 and 364 are kept insulated by the cleaning operation so that the contact detecting rods 363 and 364 can keep high resistance against the evaporation cauldron 310.

The liquid component, which is the main ingredient of the raw sewage stored in the evaporation cauldron 310, is successively evaporated by the heating operation by the heater 331 and the stirring operations of the stirring blades 333 and 334. When the heating operation by the heater 331 continues, the heater 331 still continues to heat the evaporation cauldron even after all the raw sewage in the evaporation cauldron 310 is evaporated. If the heating operation by the heater 331 continues, the heater 331 will be broken while the drive mechanism 314 will be kept driven whereby the entire arrangement of the raw sewage disposing apparatus 305 is worn. Accordingly, the drying operation should be stopped immediately after the raw sewage in the evaporation cauldron 310 is dried by evaporation completely.

It is possible to automatically stop the drying and evaporating operations in the following manner when the raw sewage in the evaporation cauldron 310 is evaporated to cope with the state set forth just above. First, the temperature of the evaporation cauldron 310 at the side surface thereof rises when all the raw sewage in the evaporation cauldron 310 is evaporated. The rise of the temperature is detected by the temperature sensor 352. The detected temperature is supplied to the temperature discrimination circuit 386. The temperature discrimination circuit 386 judges that the drying operation is completed when the temperature rises to a predetermined temperature and issues a signal which is supplied to the CPU 384.

When the temperature sensor 352 detects the change of the temperature of the evaporation cauldron 310, the drying operation should be stopped. The evaporation cauldron 310 should be cleansed before the raw sewage disposing apparatus 305 is transferred to the standby state. That is, when the raw sewage stored in the evaporation cauldron 310 is evaporated, the residual substances, such as cellulosic materials, which are nonevaporable, remain in the evaporation cauldron 310. When the residual substances are kept in the evaporation cauldron 310, the residual substances accumulate in the evaporation cauldron 310 when it is used for a long period of time, which obstructs the drying operation. Accordingly, it is necessary to remove the residual substances and the dust remaining in the evaporation cauldron 310 and cleanse the evaporation cauldron 310 by heat, after stopping the evaporating operation every time the drying operation is completed.

When the completion of the drying operation is determined by the temperature discrimination circuit 386, the CPU 384 issues a signal which is supplied to the motor control circuit 391 whereby the motor 340 of the air blower 322 is actuated while the drive mechanism 314 and the motor 344 of the air blower 323 are kept actuated. As a result, the fresh air under high pressure is forced to flow in the air introduction pipe 324, the first closing valve 325 and the air introduction pipe 327 and thereafter is jetted from the nozzle 342 toward the bottom of the evaporation cauldron 310. The residual substances present in the evaporation cauldron 310 are blown up in the form of a fine powder. At this time, the drive mechanism 314 is kept actuated so as to crush the nonevaporable residual substances remaining in the bottom of the evaporation cauldron 310 and rotated by the heat-holding bodies 334. Accordingly, the residual substances are blown up by the air jetted from the nozzle 342 and are supplied to the dust collector 316 by way of the discharge pipe 320. The residual substances fed into the dust collector 316 drop in the dust collection box 315 and are separated from the air. The clean air separated from the residual substances passes through the secondary heat box 317 and the catalyst box 318 and is diffused outside the apparatus.

The cleaning operation is carried out any time the drying and evaporating operations are performed. When the stool 306 is used for a long period of time, the dust and the residual substances are accumulated in the dust collection box 315. Accordingly, the dust collection box 315 is inspected and taken out from the raw sewage disposing apparatus 305, during routine maintenance of the raw sewage disposing apparatus 305, so that the dust and the residual substances can be removed from the dust collection box 325 whereby the raw sewage disposing apparatus 305 can be used for a long period of time.

When the residual substances in the evaporation cauldron 310 are removed by the air under pressure from the air blower 322, the stool 306 should be returned to the standby state for the next user. When the temporary toilet 301 is not used for a long time at night and the like, the stool 306 should be maintained in the standby state. A predetermined time elapses after the issuance of the signal from the temperature discrimination circuit 386 to the CPU 384 so as to return the apparatus to the standby state, which is judged by the CPU 384 after the completion of the cleaning operation.

When the CPU 384 judges that the standby state should be established, the CPU 384 supplies instruction signals to the motor control circuit 391, the valve control circuit 392 and the heater control circuit 394 so that these circuits can be switched to the standby state. The motor 340 stops its operation upon reception of the instruction signal to thereby stop the supply from the air blower 322. The drive mechanism 324 stops its rotary operation. However, the motor 334 is kept rotating. The valve control circuit 392 closes the first closing valve 325 and opens the second closing valve 326. The heater 331 is energized by the heater control circuit 394 while the heater 335 and the secondary heater 336 are respectively energized thereby.

This state is the same as the standby state wherein only the motor 344, the heater 335 and the secondary heater 336 are operated. When the first and second solenoid valves 325 and 326 are switched, the air drawn by the negative pressure generated in the ejector 319 is forced to flow in the air route, namely, the air flows in the stopped air blower 322, the air introduction pipe 324, the second closing valve 326, the air introduction pipe 328, the heat box 317 and the catalyst box 338. This is intentionally caused to prevent the temperature in the catalyst 338 from being reduced too far so that the apparatus will be capable of coping with the next drying operation quickly. The standby state is continued until the power switch 389 is turned off.

When the power switch 389 is turned off, the CPU 384 judges that the entire arrangement of the raw sewage disposing apparatus 305 should be stopped and supplies signals to the motor control circuit 391 to thereby stop the motor 340 and to the heater control circuit 394 to thereby deenergize the heater 335 and the secondary heater 336. As a result, the raw sewage disposing apparatus 305 is stopped.

The conductive contact detecting rods 363 and 364 are used for detecting the liquid level in the evaporation cauldron 310 utilizing the raw sewage as the conductive material. However, an electrostatic detecting plate can be disposed in the evaporation cauldron 310, in place of the contact detecting rods 363 and 364, for discriminating the variation of an electrostatic potential between the liquid level and the electrostatic detecting plate whereby the electrostatic detecting plate can judge that the liquid level exceeds the predetermined level when the variation of the electrostatic potential exceeds the predetermined value.

Since the liquid level detecting sensors are disposed in the evaporation cauldron 310, it is possible to prevent the amount of raw sewage from exceeding the disposing capacity and to maintain an operation in which it is capable of drying and evaporating the raw sewage within the drying capacity. Accordingly, it is possible to always effect the drying and evaporating operations in a proper drying cycle without applying an excessive load to the evaporation cauldron so that the drying cycle can be made periodically without applying the excessive load to the raw sewage disposal apparatus. Accordingly, it is possible to prevent damage from occurring and to improve the durability of the equipment.

Fourth Embodiment (FIGS. 25 to 33)

A raw sewage disposing apparatus according to the fourth embodiment will be described with reference to FIGS. 25 to 33.

The raw sewage disposing apparatus according to the fourth embodiment is substantially the same as those of the second and third embodiments. Accordingly, described hereinafter are mainly the physical structures and operation techniques of the raw sewage disposal apparatus which are different from those of the second and third embodiments.

The parts in FIGS. 25 to 33 which correspond to parts in FIGS. 7–13 and FIGS. 14–24 are identified by three digit reference numerals which begin with the digit "4" and the last two digits are the same as the last two digits for the same part in FIGS. 7–13 and 14–24.

A raw sewage disposal apparatus 405 comprises a drying mechanism, a blowing mechanism, a dust collection mechanism and a catalyst mechanism.

A secondary heat box 430, which is hollow inside thereof, is connected at one end thereof to an air introduction pipe 428 and at the other end thereof to one end of an air introduction pipe 431. The air introduction pipe 431 is connected at the other end thereof to the lower side surface of a catalyst box 418. An air introduction pipe 431 connected to an air blower 423 is connected to an ejector 419.

First and second closing valves 425 and 426 are connected to an air introduction pipe 425 connected to an air blower 422. A restriction pipe 429 is provided between an air introduction pipe 424 and a cleaning pipe 427 so as to extend over and bypass the first closing valve 425. The restriction pipe 429 is restricted at an inner diameter thereof for allowing the air to flow therein at a controlled rate. The second closing valve 426 is connected to the air introduction pipe 424 and is connected to the air introduction pipe 428.

The secondary heat box 430 has a secondary heater 450 for heating the air introduced from the atmosphere at a predetermined temperature. The air introduction pipe 431 is connected to an air discharge pipe 420 by way of a bypass pipe 435. A third closing valve 432 is disposed in the bypass pipe 435. A fourth closing valve 433 is disposed in the discharge pipe 420.

Figure 29:
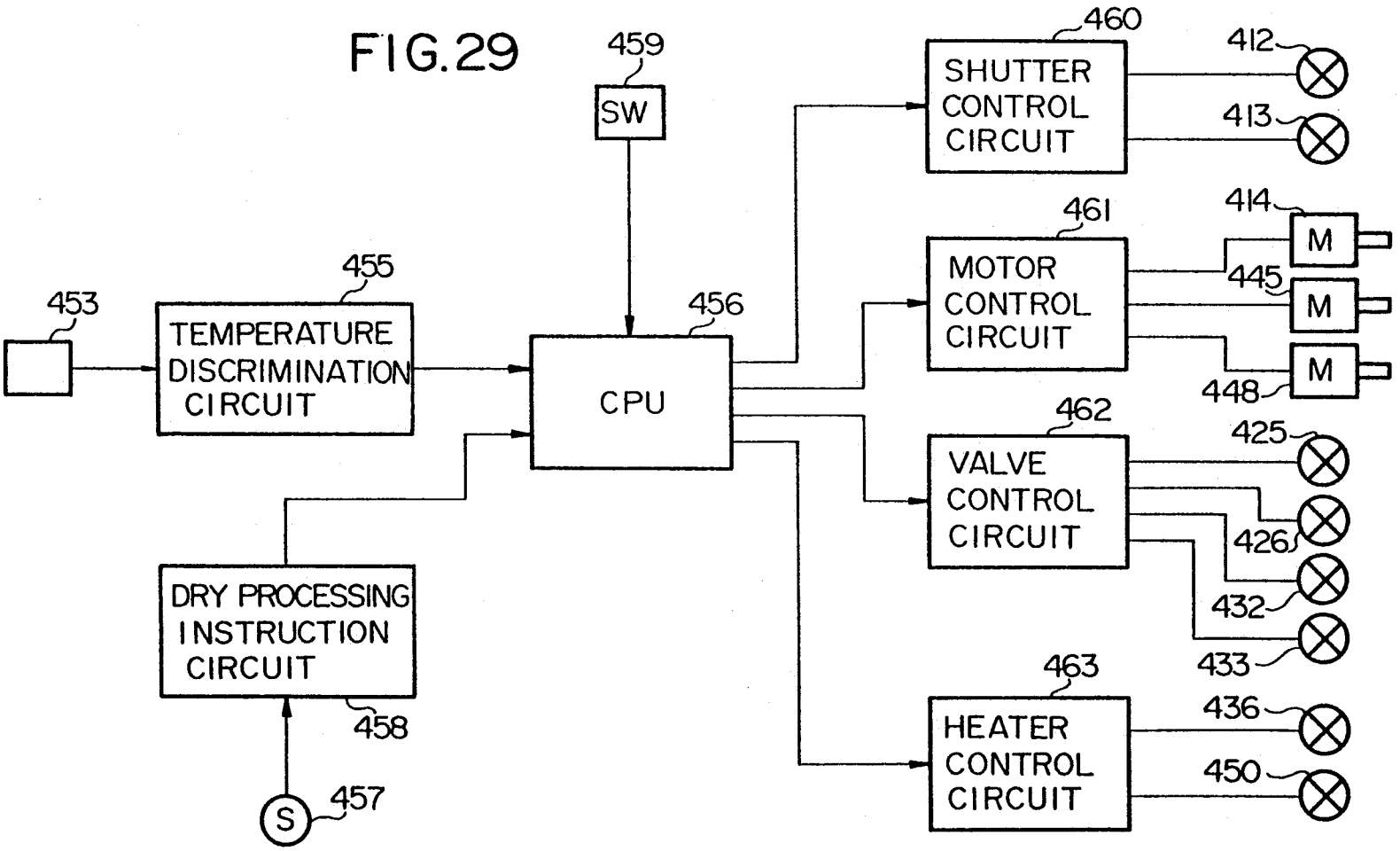
FIG. 29 is a block diagram showing a control system of the raw sewage disposal apparatus of FIG. 25.
Figure 30:
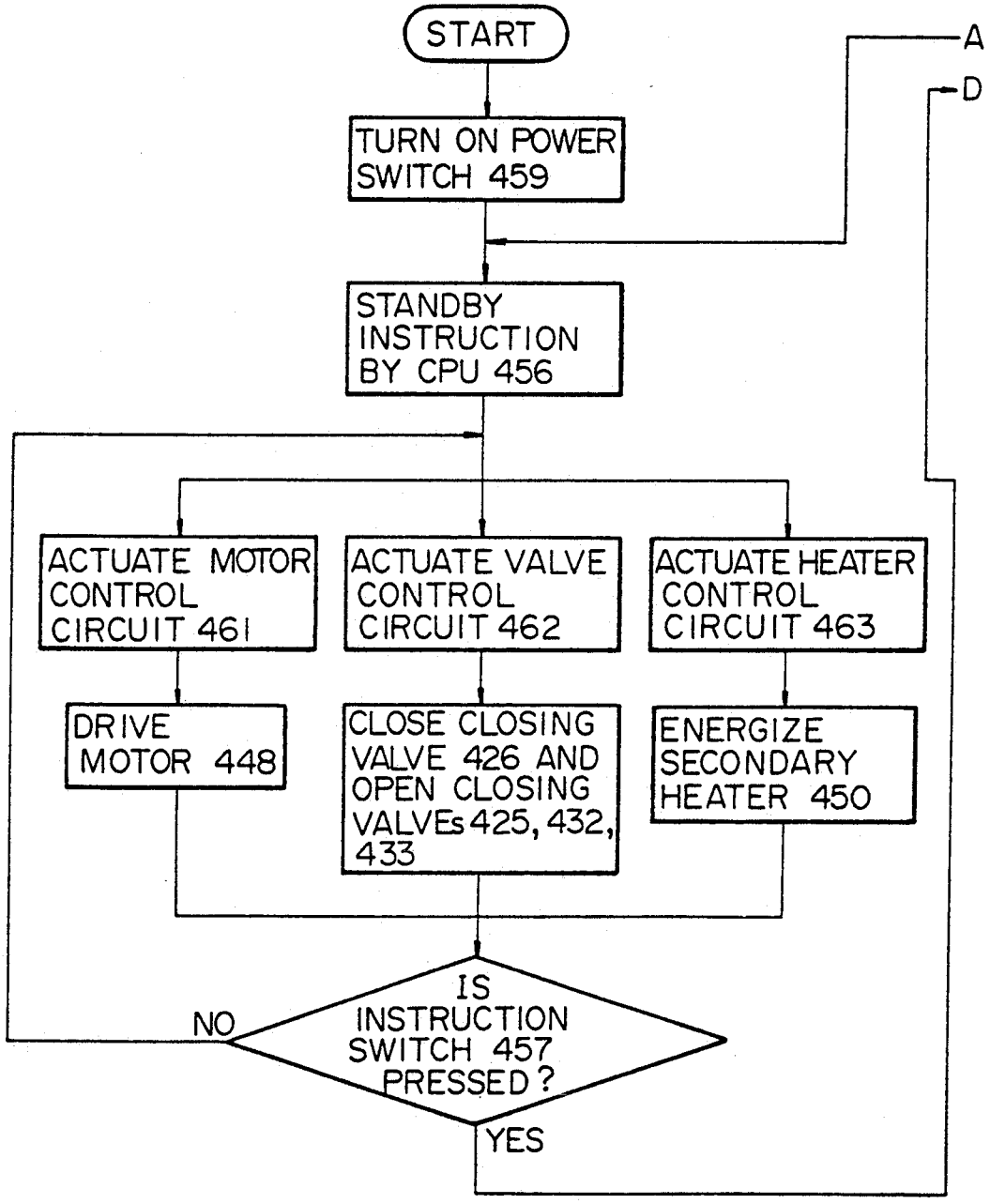
FIGS. 30 to 33 are views showing an operation of the raw sewage disposal apparatus of FIG. 25.
Figure 31:
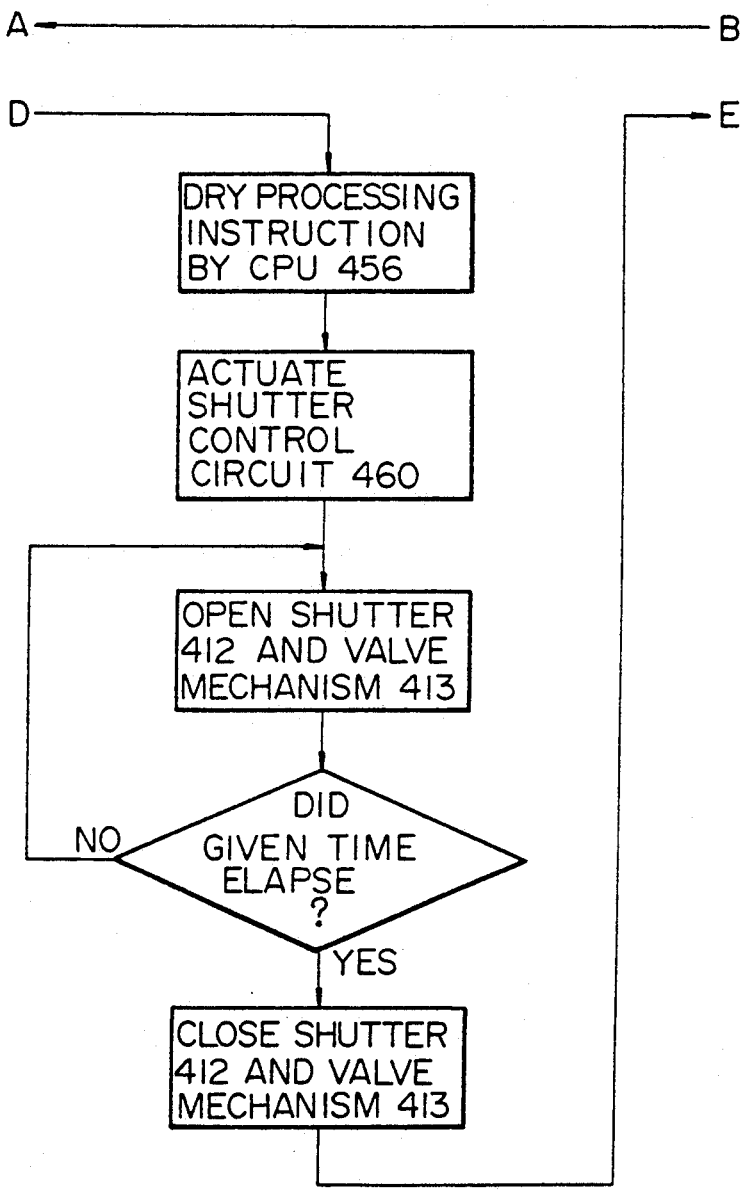
Figure 32:
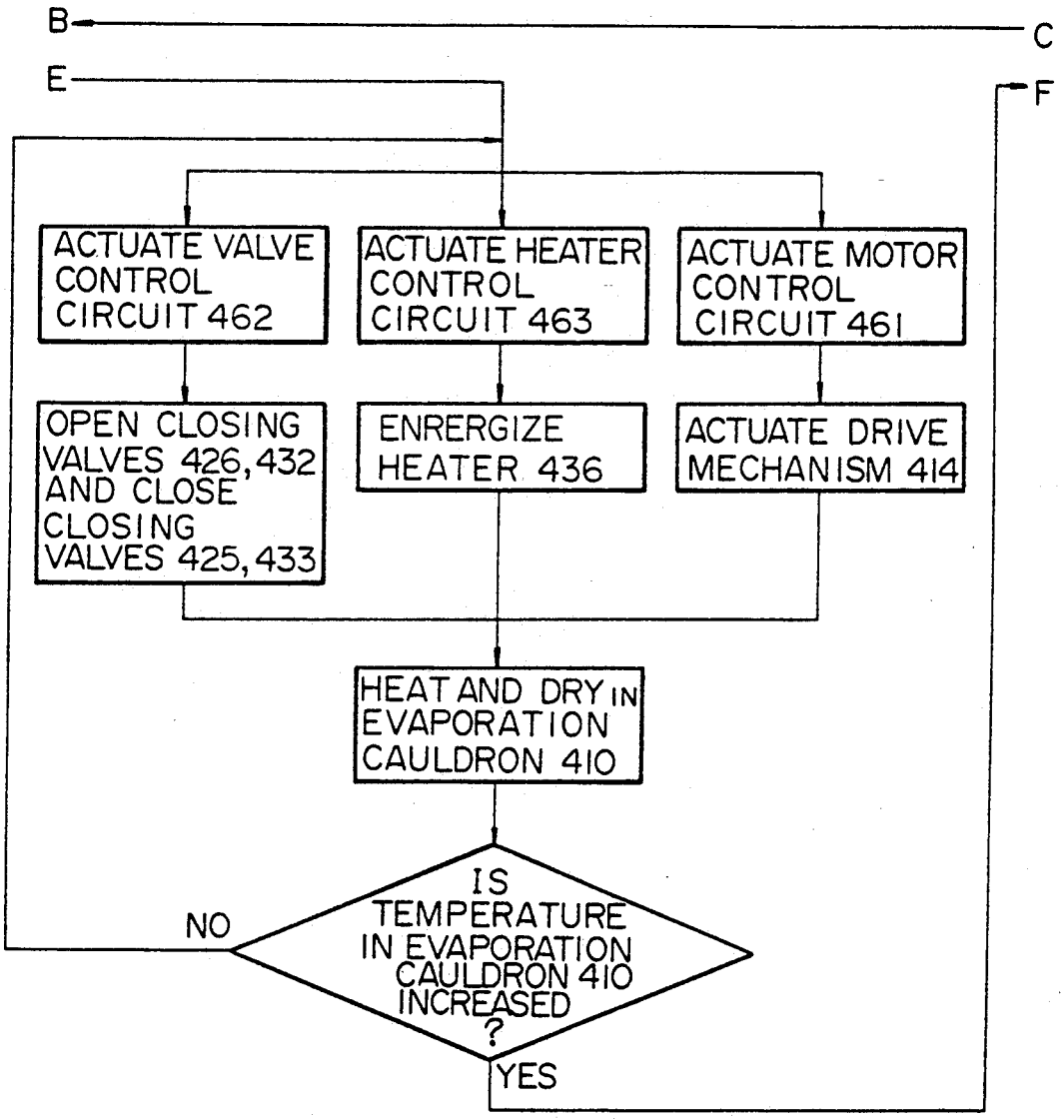
Figure 33:
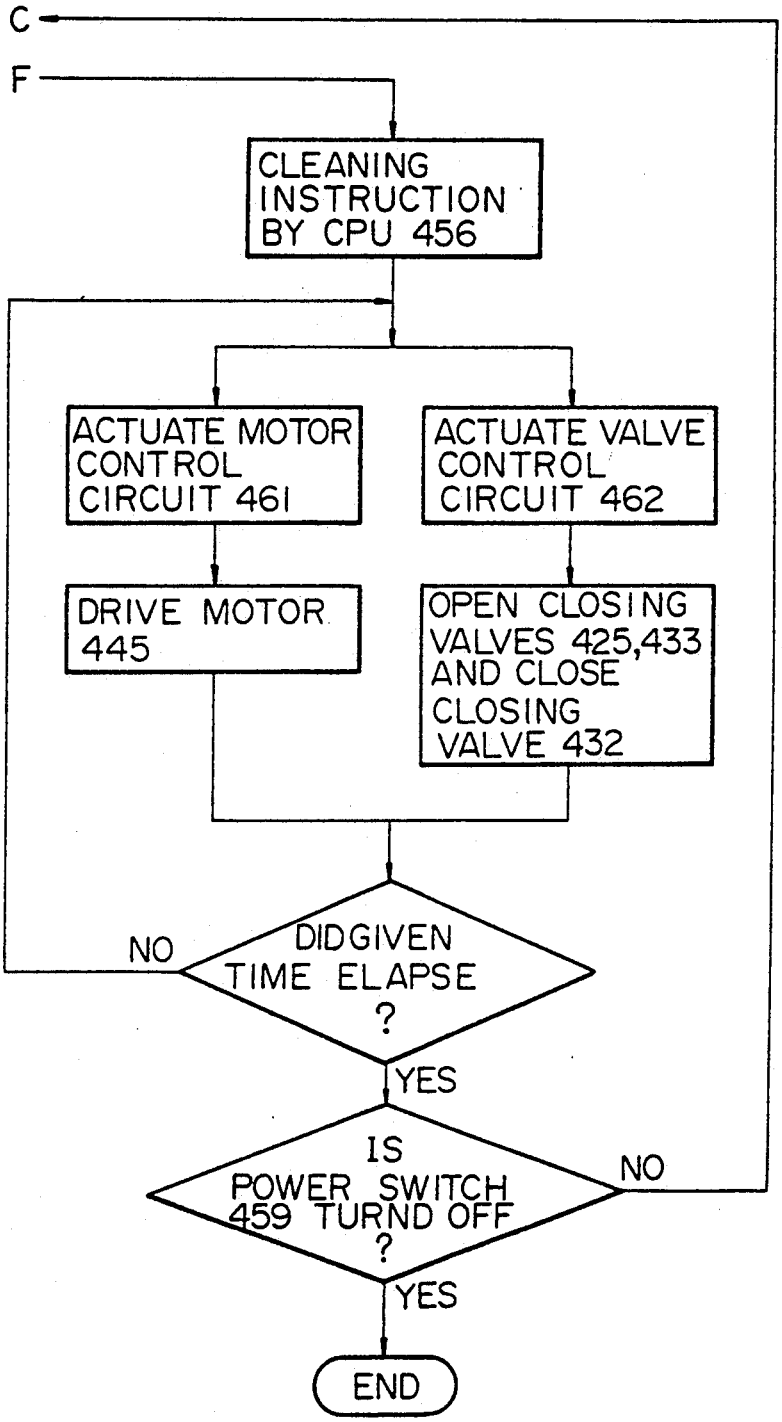

FIG. 29 is a block diagram showing a control system for a raw sewage disposing apparatus according to the fourth embodiment. An output of a temperature sensor 453 is connected to a temperature discrimination circuit 455, an output of which is connected to a CPU 456 composed of a microcomputer and the like. An output of an instruction switch 457 representing the completion of use of the stool 406 is connected to a dry processing instruction circuit 458, an output of which is connected to the CPU 456. A power switch 459 for starting the entire control system of the raw sewage disposing apparatus is connected to the CPU 456.

Outputs of the CPU are connected to a shutter control circuit 460, a motor control circuit 461, a valve control circuit 462 and a heater control circuit 463. These circuits, upon reception of instructions from the CPU 456, control each mechanism thereof. Outputs of the shutter control circuit 460 are connected to a shutter 412 and a valve mechanism 413. Outputs of the motor control circuit 461 are connected to the air blower 422, a motor 445 of the air blower 423, motors 445 and 448 and a drive mechanism 414. Outputs of the valve control circuit are separately connected to the first to fourth closing valves 425, 426, 432 and 433. Outputs of the heater control circuit 436 are connected to a heater 436 and the secondary heater 450.

The operation of the raw sewage disposing apparatus according to the fourth embodiment will be described hereinafter.

To establish the standby operation, the power switch 359 is turned on to instruct the CPU 456 to start the use of the raw sewage disposing apparatus 405. The same instruction is supplied from the CPU 456 to the motor control circuit 461, the valve control circuit 462 and the heater control circuit 463. The heater control circuit 463, upon reception of the instruction, energizes the secondary heater 450 to thereby heat the inside of the secondary heat box 430. At the same time, the motor control circuit 461, upon reception of the instruction, drives the motor 448 alone so that the fresh air, which is forced to be supplied by a fan 449 which is driven by the motor 448, flows toward the ejector 419 by way of an introduction pipe 434. At this time, the motor 445 is kept stopped.

The valve control circuit 462, upon reception of the instruction, closes the first closing valve 425 and third and fourth closing valves 432 and 433 and opens the second closing valve 426 alone.

When the user closes the instruction switch 457, the discharged raw sewage is introduced into the evaporation cauldron 410 where the drying operation is started. More in detail, when the instruction switch 457 is pressed, the instruction signal is supplied to the dry processing instruction circuit 458 and then supplied to the CPU 456. The CPU, upon reception of the instruction signal, instructs the shutter control circuit 460 so that the shutter 412 and the valve mechanism 413 are opened. The discharged raw sewage is introduced into the evaporation cauldron 410.

Simultaneously with the operation of the shutter control circuit 460, the CPU 456 controls the motor control circuit 461 to thereby drive the drive mechanism 414. When the drive mechanism is driven, the rotary shaft 437 is rotated to thereby rotate the stirring blades 438 and the heat-holding bodies 439. The valve control circuit 462, upon reception of the instruction from the CPU 456, opens the third closing valve 432 while keeping the second closing valve 426 closed and keeping the first and fourth closing valve 425 and 433 closed. As a result, there are formed a first air route through which the air circulates in the air blower 422, the air introduction pipe 424, the second closing valve 426, the air introduction pipe 428, the secondary heat box 430, the air introduction pipe 431 and the catalyst box 418 and a second air route through which the air circulates in the air blower 422, the air introduction pipe 424, the bypass pipe 435, the third closing valve 432, the air introduction pipe 431 and the catalyst box 418.

The heater control circuit 463 is controlled by the CPU to thereby energize the heater 436 so that the bottom of the evaporation cauldron 410 is heated. Accordingly, the bottom and the lower periphery of the evaporation cauldron 410 are heated by the heater 436 at the boiling point whereby the liquid component of the raw sewage is evaporated.

The motor control circuit 461 actuates the motor in the drive mechanism 414 to thereby rotate the rotary shaft 437. The plurality of heat-holding bodies 439 are rotated at the portion adjacent to the bottom of the evaporation cauldron to thereby stir the raw sewage.

The vapor generated in the evaporation cauldron 410 passes through the discharging pipe 420 and the third closing valve 432 and then enters the air introduction pipe 431. In the air introduction pipe 431, the vapor is mixed with the hot air heated in the secondary box and heated again so as to contact the catalyst 442. The vapor is subjected to oxidation-reduction whereby the bad smell component is changed to an odorless component. The air, including the vapor from the liquid component, is thereafter drawn by the ejector 419 and diffused outside.

When the liquid component of the raw sewage is driven out from the evaporation cauldron by the drying operation, the temperature in the evaporation cauldron rises. The temperature sensor 453 detects the rise of the temperature and issues a signal which is supplied to the temperature discrimination circuit 455. The temperature discrimination circuit 455 supplies the signal to the CPU 456. The CPU 456 issues a signal which is supplied to the motor control circuit 461, thereby actuating the motor 455. The fresh air under high pressure is supplied to the air introduction pipe 424 from the air blower 422 by the actuation of the motor 455. At the same time, the CPU 456 controls the valve control circuit 462 to close the third closing valve 432 and open the first and fourth closing valves 425 and 433. As a result, the air under high pressure is supplied through the air blower 422, the air introduction pipe 424 and jetted from the nozzle 447.

When the residual substances in the evaporation cauldron are removed by the air under pressure jetted by the nozzle 447, the stool 406 should be in a standby state.

After the cleaning operation is completed for the predetermined interval of time, the CPU supplies the signals to the motor control circuit 461, the valve control circuit 462 and the heater control circuit 463 whereby the drive mechanism 414 and the motor 445 are stopped and the first, third and fourth closing valves 425, 432, 436 are closed. The heater control circuit 463 deenergizes the heater 436, thereby stopping the heating of the evaporation cauldron 410.

FIGS. 30 to 34 are flowcharts showing the series of operations set forth above.

As explained above, the raw sewage can be evaporated in the hygienic manner with ease. The secondary heater is prevented from being corroded by the vapor including various component or broken so that the raw sewage disposing apparatus can be used for a long time.

What is claimed is:

1. A raw sewage disposal apparatus comprising:

a heat-resistant vessel for containing raw sewage therein;

a first introduction pipe connected for feeding raw sewage into said vessel;

heating means for heating and drying the raw sewage in said vessel;

stirring means disposed in said vessel, said stirring means having a plurality of stirring blades for stirring the raw sewage;

a multitude of heat-holding bodies contained in said vessel;

a nozzle through which a jet of air is injected into said vessel;

dust collection means for separating and collecting dust from dust-laden air discharged from said vessel;

deodorizing means communicating with said dust collection means for receiving air therefrom, said deodorizing means comprising a catalyst for treating the air for removing the bad smell from the air, and a secondary heating means for heating said catalyst; and a second introduction pipe connected to said deodorizing means for supplying fresh air thereto.

2. A raw sewage disposal apparatus adapted to be connected to a stool, according to claim 1, further comprising a cooling pipe connected at one end thereof to said deodorizing means, a condensate water tank communicating with the other end of said cooling pipe, air drawing means connected to said condensate water tank, a radiator connected to a lower end of said condensate water tank, a regulating box connected to said radiator and said condensate water tank, a second water tank connected to the regulating box by a collection pipe, and a flushing pipe connected to one end to said second water tank and the other end of which is adapted to be connected to the stool.

3. An apparatus as claimed in claim 1 in which said vessel has a bottom wall and a sidewall and said heating means is mounted on both of said bottom wall and said sidewall of said vessel, said heat-holding bodies are balls which are individually freely movable in said vessel, said nozzle extends through said sidewall close of the upper end thereof, a duct extending through said sidewall close of the upper end thereof and spaced from said nozzle so that an air stream can be discharged from said vessel through said duct, said dust collection means being a cyclone separator for flowing the air stream when laden with dust through a spiral path, removing substantially dust-free air from the upper end of the central region of said separator and collecting dust at the bottom of said separator, said deodorizing means being connected for receiving air from said cyclone separator, said secondary heating means being disposed in a space between said cyclone separator and said deodorizing means, said second introduction pipe being connected to said space so that the fresh air can be heated by said secondary heating means and then flowed through said deodorizing means.

4. An apparatus as claimed in claim 1 including a source of pressurized fresh air and valve means for selectively directing the fresh air from said source to said nozzle and said second introduction pipe.

5. An apparatus as claimed in claim 3 including a bypass pipe connected between said space and said duct and a valve for selectively directing said air stream to said cyclone separator or to said space.

6. An apparatus as claimed in claim 1 in which said vessel comprises an outer casing having an opening in an upper portion thereof, an outer cover for covering said opening, an inner casing made of heat-resistant material and disposed inside said outer casing and spaced therefrom, heat insulating material filling the space between said inner and outer casings, said inner casing having an opening in the upper portion thereof and having an inner cover for covering said opening; bearings fixed to the central portion of said outer cover and the central portion of said inner cover, a drive shaft rotatably mounted coaxially on said bearings and penetrating vertically inside said casings, the lower portion of said drive shaft being rotatably supported at the bottom of said casing, a drive mechanism connected to the upper portion of said drive shaft, said first pipe vertically penetrating said outer cover and said inner cover for introducing raw sewage into the interior of said inner casing.

7. An apparatus according to claim 1, including air-drawing means for drawing air through said deodorizing means, said air-drawing means comprising an ejector nozzle, means for flowing a jet of air at a high velocity through the central portion of said nozzle, said nozzle having a suction chamber surrounding the jet, said suction chamber being connected to receive air from said deodorizing means, and a venturi-shaped diffuser downstream of said suction chamber.

8. A raw sewage disposal apparatus adapted to be connected to a stool, comprising:

a heat-resistant vessel for containing raw sewage therein;

an introduction pipe connectible at one end to the stool and connected at the other end to said vessel for introducing raw sewage into said vessel;

valve means in said introduction pipe;

heating means for heating and drying the raw sewage vessel;

stirring means disposed in said vessel, said stirring means having a plurality of stirring blades for stirring the raw sewage;

a multitude of heat-holding bodies contained in said vessel;

a nozzle through which a jet of air is injected into said vessel;

dust collection means disposed alongside said vessel for separating and collecting the dust from dust-laden air discharged from said vessel;

deodorizing means having a catalyst therein for treating the air to remove the bad smell from the air;

first auxiliary heating means connected to said deodorizing means and second auxiliary heating means connected to said dust collection means;

a fresh air introduction pipe connected to said first auxiliary heating means; and an air-drawing means connected to said deodorizing means for drawing the air through said deodorizing means.

9. An apparatus as claimed in claim 8 in which said vessel has a bottom wall and a sidewall and said heating means is mounted on both of said bottom wall and said sidewall of said vessel, said heat-holding bodies are balls which are individually freely movable in said vessel, said nozzle extends through said sidewall close of the upper end thereof, a duct extending through said sidewall close of the upper end thereof and spaced from said nozzle so that an air stream can be discharged from said vessel through said duct, said dust collection means being a cyclone separator for flowing the air stream when laden with dust through a spiral path, removing substantially dust-free air from the upper end of the central region of said separator and collecting dust at the bottom of said separator, said deodorizing means being connected for receiving air from said cyclone separator, said secondary heating means being disposed in a space between said cyclone separator and said deodorizing means, said second introduction pipe being connected to said space so that the fresh air can be heated by said secondary heating means and then flowed through said deodorizing means.

10. An apparatus as claimed in claim 8, including a source of pressurized fresh air and valve means for selectively directing the fresh air from said source to said nozzle and said second introduction pipe.

11. An apparatus as claimed in claim 8 in which said vessel comprises an outer casing having an opening in an upper portion thereof, an outer cover for covering said opening, an inner casing made of heat-resistant material and disposed inside said outer casing and spaced therefrom, heat insulating material filling the space between said inner and outer casing, said inner casing having an opening in the upper portion thereof and having an inner cover for covering said opening; bearings fixed to the central portion of said outer cover and the central portion of said inner cover, a drive shaft rotatably mounted coaxially on said bearings and penetrating vertically inside said casings, the lower portion of the drive shaft being rotatably supported at the bottom of said casing, a drive mechanism connected to the upper portion of said drive shaft, said first pipe vertically penetrating said outer cover and said inner cover for introducing raw sewage into the interior of said inner casing.

12. An apparatus according to claim 8 including air-drawing means for drawing air through said deodorizing means, said air-drawing means comprising an ejector nozzle, means for flowing a jet of air at a high velocity through the central portion of said nozzle, said nozzle having a suction chamber surrounding the jet, said suction chamber being connected to receive air from said deodorizing means, and a venturi-shaped diffuser downstream of said suction chamber.

13. A raw sewage disposal apparatus adapted to be connected to a stool, comprising:

a heat-resistant vessel for containing raw sewage therein;

an introduction pipe connectible at one end to the stool and connected at the other end to said vessel for introducing the raw sewage in said vessel;

valve means provided in said introduction pipe;

heating means for heating and drying the raw sewage in said vessel;

stirring means disposed in said vessel, said stirring means having a plurality of stirring blades for stirring the raw sewage;

a multitude of heat-holding bodies contained in said vessel;

a nozzle through which a jet of air is injected into said vessel;

dust collection means disposed alongside the vessel for separating and collecting the dust from the dust-laden air discharged from said vessel;

deodorizing means having therein a catalyst for treating the air to remove the bad smell from the air;

first auxiliary heating means connected to said deodorizing means and second auxiliary heating means connected to said dust collection means;

a fresh air introduction pipe connected to said first auxiliary heating means;

an air-drawing means connected to said deodorizing means for drawing air through said deodorizing means;

a liquid level detecting means provided on the peripheral surface of said vessel; and a temperature sensor provided on the peripheral surface of said vessel.

14. A raw sewage disposal apparatus according to claim 13, wherein said liquid level detecting means comprises retaining bodies having metal fittings on the peripheries thereof fixed to said vessel, and contact detecting rods disposed in parallel with each other and fixed to said retaining bodies.

15. An apparatus as claimed in claim 13 in which said vessel has a bottom wall and a sidewall and said heating means is mounted on both of said bottom wall and said sidewall of said vessel, said heat-holding bodies are balls which are individually freely movable in said vessel, said nozzle extends through said sidewall close of the upper end thereof, a duct extending through said sidewall close of the upper end thereof and spaced from said nozzle so that an air stream can be discharged from said vessel, said dust collection means being a cyclone separator for flowing the air stream when laden with dust through a spiral path, removing substantially dust-free air from the upper end of the central region of said separator and collecting dust at the bottom of said separator, said deodorizing means being connected for receiving air from said cyclone separator, said secondary heating means being disposed in a space between said cyclone separator and said deodorizing means, said second introduction pipe being connected to said space so that the fresh air can be heated by said secondary heating means and then flowed through said deodorizing means.

16. An apparatus as claimed in claim 13 including a source of pressurized fresh air and valve means for selectively directing the fresh air from said source to said nozzle and said second introduction pipe.

17. An apparatus as claimed in claim 15 including a bypass pipe connected between said space and said duct and a valve for selectively directing said air stream to said cyclone separator or to said space.

18. An apparatus as claimed in claim 13 in which said vessel comprises an outer casing having an opening in an upper portion thereof, an outer cover for covering said opening, an inner casing made of heat-resistant material and disposed inside said outer casing and spaced therefrom, heat insulating material filling the space between said inner and outer casings, said inner casing having an opening in the upper portion thereof and having an inner cover for covering said opening; bearings fixed to the central portion of said outer cover and the central portion of said inner cover, a drive shaft rotatably mounted coaxially on said bearings and penetrating vertically inside said casings, the lower portion of said drive shaft being rotatably supported at the bottom of said casing, a drive mechanism connected to the upper portion of said drive shaft, said first pipe vertically penetrating said outer cover and said inner cover for introducing raw sewage into the interior of said inner casing.

19. An apparatus according to claim 13 including air-drawing means for drawing air through said deodorizing means, said air-drawing means comprising an ejector nozzle, means for flowing a jet of air at a high velocity through the central portion of said nozzle, said nozzle having a suction chamber surrounding the jet, said suction chamber being connected to receive air from said deodorizing means, and a venturi-shaped diffuser downstream of said suction chamber.

20. A raw sewage disposal apparatus adapted to be connected to a stool, comprising:

a heat-resistant vessel for containing raw sewage therein;

an introduction pipe connectible at one end thereof to the stool and connected at the other end thereof to said vessel for introducing the raw sewage into said vessel;

valve means provided in said introduction pipe;

heating means for heating and drying the raw sewage;

stirring means disposed in said vessel, said stirring means having a plurality of stirring blades for stirring the raw sewage;

a multitude of heat-holding bodies contained in said vessel;

a nozzle through which a jet of air is injected into said vessel;

dust collection means disposed alongside said vessel for separating and collecting the dust from the dust-laden air discharged from said vessel;

deodorizing means communicating with said dust collection means and having therein a catalyst for treating the air to remove the bad smell from the air;

a secondary heating means connected at one end thereof to said air introduction pipe and connected at the other end thereof to said deodorizing means; and an air-drawing means connected to said deodorizing means for drawing the air through the deodorizing means.

21. An apparatus as claimed in claim 20 in which said vessel has a bottom wall and a sidewall and said heating means is mounted on both of said bottom wall and said sidewall of said vessel, said heat-holding bodies are balls which are individually freely movable in sid vessel, said nozzle extends through said sidewall close of the upper end thereof, a duct extending through said sidewall close of the upper end thereof and spaced from said nozzle so that an air stream can be discharged from said vessel through said duct, said dust collection means being a cyclone separator for flowing the air stream when laden with dust through a spiral path, removing substantially dust-free air from the upper end of the central region of said separator and collecting dust at the bottom of said separator, said deodorizing means being connected for receiving air from said cyclone separator, said secondary heating means being disposed in a space between said cyclone separator and said deodorizing means, said second introduction pipe being connected to said space so that the fresh air can be heated by said secondary heating means and then flowed through said deodorizing means.

22. An apparatus as claimed in claim 20 including a source of pressurized fresh air and valve means for selectively directing the fresh air from said source to said nozzle and said second introduction pipe.

23. An apparatus as claimed in claim 21 including a bypass pipe connected between said space and said duct and a valve for selectively directing said air stream to said cyclone separator or to said space.

24. An apparatus as claimed in claim 20 in which said vessel comprises an outer casing having an opening in an upper portion thereof, an outer cover for covering said opening, an inner casing made of heat-resistant material and disposed inside said outer casing and spaced therefrom, heat insulating material filling the space between said inner and outer casings, said inner casing having an opening in the upper portion thereof and having an inner cover for covering said opening; bearings fixed to the central portion of said outer cover and the central portion of said inner cover, a drive shaft rotatably mounted coaxially on said bearings and penetrating vertically inside said casings, the lower portion of said drive shaft being rotatably supported at the bottom of said casing, a drive mechanism connected to the upper portion of said drive shaft, said first pipe vertically penetrating said outer cover and said inner cover for introducing raw sewage into the interior of said inner casing.

25. An apparatus according to claim 20 including air-drawing means for drawing air through said deodorizing means, said air-drawing means comprising an ejector nozzle, means for flowing a jet of air at high velocity through the central portion of said nozzle, said nozzle having a suction chamber surrounding the jet, said suction chamber being connected to receive air from said deodorizing means, and a venturi-shaped diffuser downstream of said suction chamber.

* * * * *

UNITED STATES PATENT AND TRADEMARK OFFICE

CERTIFICATE OF CORRECTION

PATENT NO. : 5 257 466

DATED : November 2, 1993

INVENTOR(S) : Mitsuhiro Kishi

It is certified that error appears in the above-identified patent and that said Letters Patent is hereby corrected as shown below:

Column 27, line 43; after "sewage" insert ---in said---.

Signed and Sealed this

Thirty-first Day of May, 1994

*Attest:*

*Attesting Officer*

BRUCE LEHMAN

*Commissioner of Patents and Trademarks*